US006773876B2

(12) United States Patent
Urabe et al.

(10) Patent No.: US 6,773,876 B2
(45) Date of Patent: Aug. 10, 2004

(54) SILVER HALIDE EMULSION, PRODUCTION PROCESS THEREOF AND NOVEL PYRIDINIUM COMPOUND

(75) Inventors: Shigeharu Urabe, Kanagawa (JP); Shinichi Ichikawa, Kanagawa (JP); Kazutaka Takahashi, Kanagawa (JP); Tadashi Inaba, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/059,003

(22) Filed: Jan. 30, 2002

(65) Prior Publication Data

US 2002/0155399 A1 Oct. 24, 2002

(30) Foreign Application Priority Data

Feb. 2, 2001 (JP) ..... P.2001-027141
Aug. 2, 2001 (JP) ..... P.2001-234986

(51) Int. Cl.[7] ..... G03C 1/07; G03C 1/015
(52) U.S. Cl. ..... 430/569; 430/567; 430/600
(58) Field of Search ..... 430/567, 569, 430/600

(56) References Cited

U.S. PATENT DOCUMENTS 5,411,851 A * 5/1995 Maskasky ..... 430/567
5,432,052 A * 7/1995 Ohshima ..... 430/567
5,612,175 A 3/1997 Eshelman et al.
5,998,124 A * 12/1999 Ohzeki et al. ..... 430/569
6,403,295 B1 * 6/2002 Urabe ..... 430/569
6,458,522 B1 * 10/2002 Taniguchi et al. ..... 430/600
6,479,230 B1 * 11/2002 Morimoto ..... 430/569
2002/0058215 A1 * 5/2002 Takahashi et al. ..... 430/567

FOREIGN PATENT DOCUMENTS

EP 0 723 187 A1 7/1996
EP 0 896 245 A1 2/1999
JP 2000/250157 * 9/2000
JP 2001/092070 * 4/2001
JP 2001/147500 * 5/2001
JP 2001/343717 * 12/2001

* cited by examiner

*Primary Examiner*—Richard L. Schilling
(74) *Attorney, Agent, or Firm*—Sughrue Mion, PLLC

(57) ABSTRACT

A silver halide emulsion comprising tabular grains having a very small thickness with the main surfaces thereof having a very large surface area and being (111) face, is disclosed.

More specifically, a silver halide emulsion is disclosed, comprising light-sensitive silver halide grains having a silver bromide content of 70 mol % or more, with 60 % or more of the entire projected area of said silver halide grains being occupied by tabular grains having an average grain thickness of less than 0.04 $\mu$m, an average equivalent-circle diameter of 4 $\mu$m or more, and (111) face as main surfaces.

6 Claims, No Drawings

SILVER HALIDE EMULSION, PRODUCTION PROCESS THEREOF AND NOVEL PYRIDINIUM COMPOUND

FIELD OF THE INVENTION

The present invention relates to a tabular grain having a very small thickness, a high aspect ratio and a large equivalent-circle diameter; a silver halide emulsion comprising the tabular grain; a process for producing the silver halide emulsion; and a novel crystal phase-controlling agent compound suitable for the production of the tabular grain.

BACKGROUND OF THE INVENTION

The tabular silver halide grain (hereinafter referred to as a "tabular grain") has the following photographic properties:

1) the ratio of surface area to volume (hereinafter referred to as a "specific surface area") is large and a large amount of sensitizing dye can be adsorbed to the surface of the grain, so that the color sensitization sensitivity can be relatively high as compared with the intrinsic sensitivity;
2) when an emulsion containing tabular grains is coated and dried, the grains are oriented in parallel to the support surface, so that the coated layer can be reduced in the thickness and the photographic light-sensitive material obtained can have good sharpness;
3) in an X-ray photographic system, when a sensitizing dye is added to the tabular grain, the silver halide cross-over light can be extremely reduced and therefore, the deterioration of image quality can be prevented;
4) light scattering is reduced and therefore, an image of high resolution can be obtained; and
5) the sensitivity to blue light is low, so that when the tabular grain is used in a green-sensitive layer or a red-sensitive layer, a yellow filter can be removed from the emulsion.

By virtue of these advantageous properties, tabular grains have been heretofore used in commercially available light-sensitive materials.

JP-B-6-44132 (the term "JP-B" as used herein means an "examined Japanese patent publication") and JP-B-5-16015 disclose a tabular grain emulsion having an aspect ratio of 8 or more. The aspect ratio as used herein means a ratio of the equivalent-circle diameter to the thickness of a tabular grain. The diameter of a grain as used herein means the diameter of a circle having an area equal to the projected area of a grain when the emulsion is observed through a microscope or an electron microscope. The thickness is shown by the distance between two parallel main surfaces constituting a tabular silver halide.

JP-B-4-36374 discloses a color photographic light-sensitive material which is improved in the sharpness, sensitivity and graininess by using tabular grains having a thickness of less than 0.3 $\mu$m and a diameter of 0.6 $\mu$m or more in at least one layer of green-sensitive emulsion layer and red-sensitive emulsion layer.

In recent years, with the progress of silver halide light-sensitive materials designed to have higher sensitivity and smaller format, a color light-sensitive material having higher sensitivity and improved image quality is keenly demanded. To meet this requirement, the silver halide emulsion is demanded to have higher sensitivity and more excellent graininess. Conventional tabular silver halide emulsions cannot cope with these requirements and more improvement of the performance is demanded.

As the aspect ratio of a tabular grain is larger, the specific surface area is larger and the above-described advantageous properties of a tabular grain can be more effectively utilized. In other words, a larger amount of a sensitizing dye is adsorbed to a larger surface area and a larger intensity of light is absorbed per one grain, whereby higher sensitivity can be obtained. Therefore, many studies have been heretofore made to prepare tabular grains reduced in the thickness. JP-B-5-12696 discloses a method of oxidizing and thereby ineffectuating a methionine group in gelatin and preparing thin tabular grains using the gelatin as a dispersion medium, JP-A-8-82883 (the term "JP-A" as used herein means an "unexamined published Japanese patent application") discloses a method of ineffectuating the amino group and the methionine group in gelatin and preparing thin tabular grains using the gelatin as a dispersion medium, and JP-A-10-148897 discloses a method of chemically modifying the amino group in gelatin to introduce at least two or more carboxyl groups and preparing thin tabular grains using the gelatin as a dispersion medium.

As for a tabular grain having a very large equivalent-circle diameter and a very small thickness, U.S. Pat. No. 5,612,175 discloses the tabular grain. In Examples of this patent, silver bromide tabular grains having a thickness of less than 0.1 $\mu$m and an average equivalent-circle diameter of several $\mu$m are disclosed. In the Examples, the thinnest tabular grain had a thickness of 0.04 $\mu$m and an average equivalent-circle diameter of 3.9 $\mu$m. European Patent 896,245 discloses, in the Example, a tabular grain having a thickness of 0.048 $\mu$m and an average equivalent-circle diameter of 3.74 $\mu$m. The tabular grains disclosed in these patents are expected to ensure high sensitivity and good graininess because of their very small thickness and very large main surfaces, however, in order to satisfy the recent requirement for higher sensitivity, tabular grains are still demanded to have a smaller thickness and larger main surfaces.

A crystal phase-controlling agent is an effective material for forming thin tabular grains, however, only with known compounds, the demanded aspect ratio cannot be achieved. For obtaining yet higher sensitivity, a crystal phase-controlling agent having higher performance, namely, a crystal phase-controlling agent having higher selectivity for the (111) face of a silver halide grain is being demanded. On the other hand, the crystal phase-controlling agent itself disadvantageously inhibits the adsorption of a sensitizing dye or chemical sensitization and therefore, is preferred not to be present on a tabular grain at the time of adding a sensitizing dye or at the chemical sensitization. From these reasons, a step of removing the crystal phase-controlling agent by water washing or the like is generally provided after the grain formation or before or after the adsorption of a sensitizing dye, however, the crystal phase-controlling agent cannot be completely removed and at present, this problem cannot be satisfactorily solved. In this meaning, a crystal phase-controlling agent which can be easily removed after the grain formation is demanded.

It is a well-known fact in the art that a silver halide emulsion is gradually sensitized due to naturally occurring radiation and with the passage of a long time, fogging is already generated before the exposure for the image recording and seriously deteriorates the image quality obtained by the exposure. In a silver halide emulsion, a latent image is formed on a silver halide grain upon exposure and thereby an image is recorded. For achieving high sensitivity, the size of silver halide grain must be increased to elevate the intensity of light absorbed at the exposure. On other hand, the absorption of naturally occurring radiation is, as well known, proportional to the volume of a silver halide. Thus, a silver halide emulsion may have higher sensitivity but at the same time, suffers from the increase of fogging due to radiation. Many efforts have been heretofore made to solve this problem but a definite method for solving this problem is not yet discovered. For solving this difficult problem, the effective means is to realize a grain having a very small thickness and a very large main surface area. More specifically, it is obvious that the intensity of light absorbed into a silver halide at the recording of an image is proportional to the amount of a sensitizing dye adsorbed to the surface of a silver halide grain and the amount of a sensitizing dye is proportional to the surface of a silver halide grain. On the other hand, the absorption of radiation is, as described above, proportional to the volume of a silver halide.

Accordingly, the tabular grain having a very large main surface area and a very small thickness and thereby having a very small grain volume, disclosed in the present invention, can solve the above-described difficult problem.

SUMMARY OF THE INVENTION

A first object of the present invention is to provide a silver halide emulsion comprising tabular grains, in which the tabular grain has a very small thickness and the main surface thereof is a (111) face and has a very large surface area. A second object of the present invention is to provide a crystal phase-controlling agent which can ensure the formation of silver halide grains having a high aspect ratio and which can be easily removed after the grain formation. A third object of the present invention is to provide a silver halide grain having a high aspect ratio, which is formed using the crystal phase-controlling agent, and a process for producing a silver halide emulsion containing the silver halide grain.

The above-described objects of the present invention can be attained by the following means.

(1) A silver halide emulsion comprising light-sensitive silver halide grains having a silver bromide content of 70 mol % or more, with 60% or more of the entire projected area of the silver halide grains being occupied by tabular grains having an average grain thickness of less than 0.04 μm, an average equivalent-circle diameter of 4 μm or more, and (111) face as main surfaces.

(2) The silver halide emulsion as described in (1), wherein 75% or more of the entire projected area of the silver halide grains is occupied by tabular grains having an average grain thickness of less than 0.04 μm, an average equivalent-circle diameter of 4 μm or more, and (111) face as main surfaces.

(3) The silver halide emulsion as described in (1), wherein 90% or more of the entire projected area of the silver halide grains is occupied by tabular grains having an average grain thickness of less than 0.04 μm, an average equivalent-circle diameter of 4 μm or more, and (111) face as main surfaces.

(4) A method for producing the silver halide emulsion described in (1), (2) or (3), comprising nucleation, ripening and growth steps and performing these steps while letting at least one compound represented by the following formula (I), (II) or (III) be absent at the time of nucleation and be present at the time of ripening and growth to obtain an emulsion comprising tabular grains, wherein a mixing vessel is separately provided from a reactor for performing the nucleation and/or growth of silver halide grains, an aqueous solution of a water-soluble silver salt and an aqueous solution of a water-soluble halide are fed to the mixing vessel and mixed to form silver halide fine grains, and the fine grains are immediately fed to the reactor to perform the nucleation and/or growth of silver halide grains in the reactor:

(I)

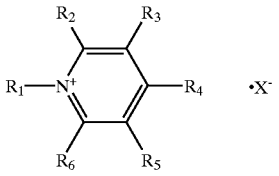

wherein $R_1$ represents an alkyl group, an alkenyl group or an aralkyl group, $R_2$, $R_3$, $R_4$, $R_5$ and $R_6$ each represents a hydrogen atom or a substituent, each of the pairs $R_2$ and $R_3$, $R_3$ and $R_4$, $R_4$ and $R_5$, and $R_5$ and $R_6$ may form a condensed ring, provided that at least one of $R_2$, $R_3$, $R_4$, $R_5$ and $R_6$ represents an aryl group, and $X^-$ represents a counter anion;

(II)

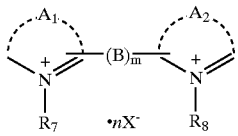

(III)

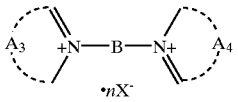

wherein $A_1$, $A_2$, $A_3$ and $A_4$, which may be the same or different, each represents a nonmetallic atom group for completing the nitrogen-containing heterocyclic ring, B represents a divalent linking group, m represents 0 or 1, $R^1$ and $R^2$ each represents an alkyl group, X represents an anion, and n represents 0, 1 or 2, provided that when an inner salt is formed, n is 0 or 1.

(5) The method for producing the silver halide emulsion as described in (1), (2) or (3), comprising nucleation, ripening and growth steps and performing a part or the whole of the growth step in the presence of an alkali-treated ossein gelatin containing 30% or more of a γ component and a component having a molecular weight higher than that of the γ component, wherein a mixing vessel is separately provided from a reactor for performing the nucleation and/or growth of silver halide grains, an aqueous solution of a water-soluble silver salt and an aqueous solution of a water-soluble halide are fed to the mixing vessel and mixed to form silver halide fine grains, and the fine grains are immediately fed to the reactor to perform the nucleation and/or growth of silver halide grains in the reactor.

(6) The method for producing a silver halide emulsion as described in (4) or (5), wherein an esterified gelatin is used as a protective colloid for forming the silver halide fine grains in the mixing vessel.

(7) A silver halide emulsion comprising a compound represented by formula (IV) or (V):

(IV)

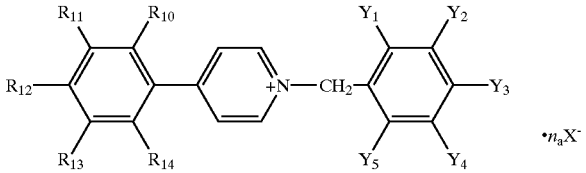

wherein $R_{10}$, $R_{11}$, $R_{12}$, $R_{13}$ and $R_{14}$ each represents a hydrogen atom or a substituent, $Y_1$, $Y_2$, $Y_3$, $Y_4$ and $Y_5$ each represents a hydrogen atom or a substituent, provided that at least one of $Y_1$, $Y_2$, $Y_3$, $Y_4$ and $Y_5$ is a group selected from the group consisting of $—SO_2NH_2$, $—SO_2NHR_{15}$, $—SO_2N(R_{15})_2$, $—SO_3^-$, $—CONH_2$, $—CONHR_{15}$, $—CON(R_{15})_2$, $—NHSO_2NH_2$, $—NHSO_2NHR_{15}$, $—NHSO_2N(R_{15})_2$ and $—SO_2NHCOR_{15}$, $X^-$ represents a counter anion, $n_a$ represents a number necessary for neutralizing the electric charge of the compound, and $R_{15}$ represents a substituted or unsubstituted alkyl, alkenyl, alkynyl or aryl group;

(V)

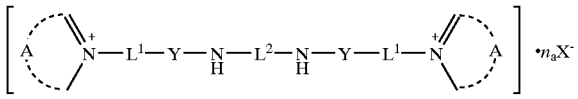

wherein A represents an organic residue for completing the nitrogen-containing aromatic heterocyclic ring and A's may be the same or different, $L^1$ and $L^2$ each represents a divalent linking group, Y represents —C(=O)—, $—SO_2—$, —NHC(=O)— or —NHC(=S)—, $X^-$ represents a counter anion, and $n_a$ represents a number necessary for neutralizing the electric charge of the compound.

(8) A silver halide grain emulsion obtained by forming the grains in the presence of a compound represented by formula (IV) or (V).

(9) A method for producing a silver halide grain emulsion, comprising performing a part or the whole of the grain formation step in the presence of a compound represented by formula (IV) or (V) to produce a silver halide emulsion comprising tabular grains having (111) face as main surfaces.

(10) The method for producing the silver halide emulsion as described in (4), wherein the compound represented by formula (I), (II) or (III) is a compound represented by formula (IV) or (V) described in the above item (7).

(11) A pyridinium compound represented by formula (IV).

(12) The pyridinium compound as described in (11), wherein in formula (IV), $R_{10}$ to $R_{14}$ each is a hydrogen atom or an alkyl group having from 1 to 3 carbon atoms and $Y_1$ to $Y_5$ each represents a hydrogen atom or $—SO_2NH_2$.

(13) A silver halide photographic light-sensitive material comprising the silver halide emulsion described in (1) to (11) or a silver halide emulsion produced by the production process described in (1) to (11).

DETAILED DESCRIPTION OF THE INVENTION

The tabular silver halide grain (tabular grain) has two parallel main surfaces opposing each other and is characterized by the ratio (aspect ratio) of the equivalent-circle diameter of the main surface (diameter of a circle having the same projected area as the main surface) to the distance between main surfaces (namely, grain thickness). In the present invention, grains having an aspect ratio of 2 or more are called a tabular grain. The average (equivalent-circle) diameter of the tabular grain of the present invention is preferably 4 to 40 μm, more preferably 5 to 30 μm. The grain thickness is less than 0.04 μm, preferably less than 0.035 μm, more preferably from 0.03 to 0.01 μm. In the silver halide emulsion of the present invention, 60% or more, preferably 75% or more, more preferably 90% or more, of the entire projected area of silver halide grains contained therein is preferably occupied by tabular grains having an average grain thickness of less than 0.04 μm, an average equivalent-circle diameter of 4 μm or more, and (111) main surfaces. The grain diameter and the grain thickness for use in the present invention can be measured and determined using an electron microphotograph of a grain according to the method described in U.S. Pat. No. 4,434,226. More specifically, the grain thickness can be easily determined by vapor-depositing a metal together with a latex for control on a grain from the oblique direction, measuring the length of the shadow thereof on an electron microphotograph and calculating the grain thickness with reference to the length of the shadow of the latex. The thickness value of a tabular grain obtained by this measuring method, however, includes the thickness of protective colloid (gelatin is generally used therefor in many cases) adsorbed to the surface of the tabular grain. Accordingly, for obtaining the true thickness of the tabular grain, the thickness of the adsorbed protective colloid layer must be subtracted from the thickness value determined by the electron microphotograph.

The method for measuring the thickness of gelatin adsorbed to a tabular grain is described in *Journal of Imaging Science and Technology,* Vol. 40, pp. 185–188 (1966). More specifically, a method of calculating the thickness of a tabular grain by saturation-adsorbing a dye of giving a known occupation area when adsorbed, and a method of hardening the adsorbed gelatin, dissolving out silver halide grains and after drying, measuring the thickness of gelatin using AFM (interatomic force microscope) are described. In this paper, it is reported that almost the same value is obtained by these two methods and the thickness of adsorbed gelatin is nearly 4 nm per one surface. In the tabular grain having a very small thickness disclosed in the present invention, the thickness of gelatin adsorbed cannot be neglected and the thickness of the tabular grain referred to in the present invention does not include this thickness of the adsorbed gelatin layer.

The tabular grain is roughly classified into those having a (111) main surface and those having a (100) main surface. The tabular grain for use in the present invention is a tabular grain having at least one (111) twin plane and a (111) main surface in parallel to the twin plane. The twin plane means such a (111) plane that ions at all lattice points on both surfaces of the (111) plane are in the relationship of a mirror image. The tabular grain for use in the present invention may have a completely triangular shape, a completely hexagonal shape or an intermediate shape therebetween. Generally, a three-fold rotational symmetry is established in a tabular grain, however, due to use of a crystal phase-controlling agent in the present invention, tabular grains having no three-fold rotational symmetry property, so-called "distorted" tabular grains, are occasionally present. For example, it is a general matter that six sides of a hexagonal tabular grain have the same length every other side and the center of one side makes an angle of 60°, however, this regularity is sometimes lacked in the tabular grains of the present invention.

In expressing the anisotropy of a tabular grain, an aspect ratio of equivalent-circle diameter/grain thickness of a tabular grain is often used as the measure therefor. The average aspect ratio of a tabular grain emulsion must be originally obtained by measuring the aspect ratio of individual grains and calculating the average value thereof, however, even when individual tabular grains are determined on the equivalent-circle diameter and the grain thickness and an average aspect ratio is calculated from respective average values, there arises no large difference therebetween. Therefore, the latter method is employed in the present invention. The tabular grain of the present invention has a large equivalent-circle diameter and a very small thickness and therefore, duly has a very high aspect ratio. The average aspect ratio of tabular grains of the present invention is preferably 100 to less than 2,000, more preferably from 100 to less than 1,000.

In the preparation of tabular grains of the present invention, the nucleation and/or growth are performed by adding silver halide fine grains to a reactor holding an aqueous solution of protective colloid, in place of adding an aqueous silver salt solution and an aqueous halide solution. The technique on this method is disclosed in U.S. Pat. Nos. 4,879,208 and 5,104,786, JP-A-1-183644, JP-A-2-44335, JP-A-2-43535 and JP-A-2-68538. In the formation of tabular grains, a fine grain silver iodide (grain size: 0.1 $\mu$m or less, preferably 0.06 $\mu$m or less) emulsion may be added as means for feeding iodide ion. At this time, the production method disclosed in U.S. Pat. No. 4,879,208 is preferably used as the means for feeding silver iodide fine grains. In such a method of performing the nucleation and/or grain growth by the addition of fine grains, the silver halide fine grains added to the reactor to prepare silver halide grains are preferably prepared using a mixing vessel disclosed in JP-A-10-239787 and JP-A-11-76783, where a stirring blade having no rotation axis passing through a stirring tank is driven to rotate within the stirring tank.

In the present invention, the temperature in the mixing vessel for forming fine grains is 50° C. or less, preferably 40° C. or less, more preferably 30° C. or less, still more preferably 20° C. or less. The temperature of the reactor in which fine grains are dissolved and tabular grains grow is 50° C. or more, preferably 60° C. or more, more preferably 70° C. or more, still more preferably 80° C. or more. The pBr (=−log($Br^-$)) value of the reactor where tabular grains grow is 2.0 or less, preferably 1.5 or less, more preferably 1.2 or less. The low pBr, namely, high bromide ion concentration is an essential condition for the growth of tabular grains of the present invention.

The halogen composition of the tabular grain is silver iodobromide, silver chloroiodobromide, silver iodobromochloride or silver chlorobromide having a silver bromide content of 70 mol % or more. The silver bromide content is preferably 80% or more, more preferably 90% or more. The structure relating to the halogen composition of the tabular grain of the present invention can be confirmed by combining the X-ray diffraction, the EPMA (sometimes also called XMA) method (a method of scanning a silver halide grain with an electron beam to detect the silver halide composition), the ESCA method (a method of irradiating an X-ray and spectroanalyzing photoelectrons coming out from the grain surface) or the like.

The compounds represented by formulae (I), (II) and (III) for use in the formation of the (111) main surface-type tabular grain of the present invention are described in detail below.

In formula (I), $R_1$ is preferably a linear, branched or cyclic alkyl group having from 1 to 20 carbon atoms (e.g., methyl, ethyl, isopropyl, tert-butyl, n-octyl, n-decyl, n-hexadecyl, cyclopropyl, cyclopentyl, cyclohexyl), an alkenyl group having from 2 to 20 carbon atoms (e.g., allyl, 2-butenyl, 3-pentenyl) or an aralkyl group having from 7 to 20 carbon atoms (e.g., benzyl, phenethyl). The groups represented by $R_1$ each may further be substituted.

$R_2$, $R_3$, $R_4$, $R_5$ and $R_6$, which may be the same or different, each represents a hydrogen atom or a group capable of substituting to the hydrogen atom (substituent). Examples of the substituent include a halogen atom, an alkyl group, an alkenyl group, an alkynyl group, an aralkyl group, an aryl group, a heterocyclic group (e.g., pyridyl, furyl, imidazolyl, piperidyl, morpholino), an alkoxy group, an aryloxy group, an amino group, an acylamino group, a ureido group, a urethane group, a sulfonylamino group, a sulfamoyl group, a carbamoyl group, a sulfonyl group, a sulfinyl group, an alkyloxycarbonyl group, an acyl group, an acyloxy group, a phosphoramide group, an alkylthio group, an arylthio group, a cyano group, a sulfo group, a carboxy group, a hydroxy group, a phosphono group, a nitro group, a sulfino group, an ammonio group (e.g., trimethylammonio), a phosphonio group and a hydrazino group. These groups each may further be substituted.

The pairs of $R_2$ and $R_3$, $R_3$ and $R_4$, $R_4$ and $R_5$, and $R_5$ and $R_6$ each may be condensed to form a quinoline ring, an isoquinoline ring or an acridine ring.

$X^-$ represents a counter anion. Examples of the counter anion include a halide ion (e.g., chloride ion, bromide ion, iodide ion), a nitrate ion, a sulfate ion, p-toluenesulfonate ion and trifluoromethanesulfonate ion.

In a preferred embodiment of formula (I), $R_1$ represents an aralkyl group and at least one of $R_2$, $R_3$, $R_4$, $R_5$ and $R_6$ represents an aryl group.

In a more preferred embodiment of formula (I), $R_1$ represents an aralkyl group, $R_4$ represents an aryl group, and $X^-$ represents a halide ion. Examples of this compound include Crystal Phase-Controlling Agents 1 to 29 described in EP-A-0723187, however, the present invention is not limited thereto.

The compounds represented by formulae (II) and (III) are described in detail below.

$A_1$, $A_2$, $A_3$ and $A_4$ each represents a nonmetallic element for completing the nitrogen-containing heterocyclic ring and may contain an oxygen atom, a nitrogen atom or a sulfur atom or may be condensed with a benzene ring. The heterocyclic ring constituted by $A_1$, heterocyclic ring constituted by $A_2$, heterocyclic ring constituted by $A_3$ and heterocyclic ring constituted by $A_4$ which may be the same or different, each may have a substituent. Examples of the substituent include an alkyl group, an aryl group, an aralkyl group, an alkenyl group, a halogen atom, an acyl group, an alkoxycarbonyl group, an aryloxycarbonyl group, a sulfo group, a carboxy group, a hydroxy group, an alkoxy group, an aryloxy group, an amido group, a sulfamoyl group, a carbamoyl group, a ureido group, an amino group, a sulfonyl group, a cyano group, a nitro group, a mercapto group, an alkylthio group and an arylthio group. Preferred examples of the nitrogen-containing heterocyclic ring constituted by $A_1$, $A_2$, $A_3$ or $A_4$ include a 5- or 6-membered ring (for example, a pyridine ring, an imidazole ring, a thiazole ring, an oxazole ring, a pyrazine ring and a pyrimidine ring). Among these, a pyridine ring is more preferred. B represents a divalent linking group. The divalent linking group means a linking group constituted by any one or a combination of two or more of alkylene, arylene, alkenylene, —$SO_2$—, —SO—, —O—, —S—, —CO— and —N($R_9$)— (wherein $R_9$ represents an alkyl group, an aryl group or a hydrogen atom). B is preferably alkylene or alkenylene.

$R_7$ and $R_8$ each is preferably an alkyl group having from 1 to 20 carbon atoms and $R_7$ and $R_8$ may be the same or different.

The alkyl group represents a substituted or unsubstituted alkyl group and examples of the substituent include those described above as the substituent of $A_1$, $A_2$, $A_3$ and $A_4$ except for an alkyl group.

$R_7$ and $R_8$ each preferably represents an alkyl group having from 4 to 10 carbon atoms, more preferably a substituted or unsubstituted aryl-substituted alkyl group. $X^-$ represents an anion such as chloride ion, bromide ion, iodide ion, nitrate ion, sulfate ion, p-toluenesulfonate or oxalate. n represents 0, 1 or 2 and when an inner salt is formed, n is 0 or 1.

Specific examples of the compounds represented by formulae (II) and (III) include Compounds (1) to (42) disclosed in JP-A-2-32 and Compounds (1) to (32) disclosed in U.S. Pat. No. 5,432,052, however, the present invention is not limited to these compounds.

The compound represented by formula (IV) is described in detail below. Among the compounds represented by formula (I), the compound represented by the following formula (IV) is preferred in view of the objects of the present invention.

(IV)

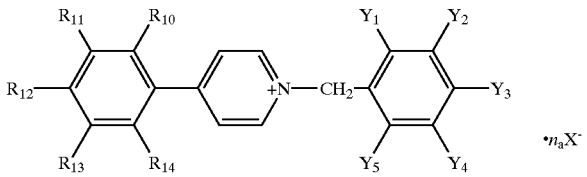

wherein $R_{10}$, $R_{11}$, $R_{12}$, $R_{13}$ and $R_{14}$ each represents a hydrogen atom or a substituent, $Y_1$, $Y_2$, $Y_3$, $Y_4$ and $Y_5$ each represents a hydrogen atom or a substituent, provided that at least one of $Y_1$, $Y_2$, $Y_3$, $Y_4$ and $Y_5$ is a group selected from the group consisting of $—SO_2NH_2$, $—SO_2NHR_{15}$, $—SO_2N(R_{15})_2$, $—SO_3^-$, $—CONH_2$, $—CONHR_{15}$, $—CON(R_{15})_2$, $—NHSO_2NH_2$, $—NHSO_2NHR_{15}$, $—NHSO_2N(R_{15})_2$ and $—SO_2NHCOR_{15}$, $X^-$ represents a counter anion, $n_a$ represents a number necessary for neutralizing the electric charge of the compound, and $R_{15}$ represents a substituted or unsubstituted alkyl, alkenyl, alkynyl or aryl group.

In formula (IV), $R_{10}$, $R_{11}$, $R_{12}$, $R_{13}$ and $R_{14}$, which may be the same or different, each represents a hydrogen atom or a substituent. Examples of the substituted represented by $R_{10}$, $R_{11}$, $R_{12}$, $R_{13}$ and $R_{14}$ include a halogen atom (e.g., chlorine atom, bromine atom, iodine atom); an alkyl group [a linear, branched or cyclic, substituted or unsubstituted alkyl group and examples thereof include an alkyl group (preferably an alkyl group having from 1 to 30 carbon atoms, e.g., methyl, ethyl, n-propyl, isopropyl, tert-butyl, n-octyl, eicosyl, 2-chloroethyl, 2-cyanoethyl, 2-ethylhexyl), a cycloalkyl group (preferably a substituted or unsubstituted cycloalkyl group having from 3 to 30 carbon atoms, e.g., cyclohexyl, cyclopentyl, 4-n-dodecylcyclohexyl), a bicycloalkyl group (preferably a substituted or unsubstituted bicycloalkyl group having from 5 to 30 carbon atoms, namely, a monovalent group resulting from removing one hydrogen atom from bicycloalkane having from 5 to 30 carbon atoms, e.g., bicyclo[1,2,2]heptan-2-yl, bicyclo[2,2,2]octan-3-yl), and a tricyclo-structure having many ring structures; the alkyl group in the substituents described below (for example, the alkyl group in an alkylthio group) represents an alkyl group having such a concept]; an alkenyl group [a linear, branched or cyclic, substituted or unsubstituted alkenyl group and examples thereof include an alkenyl group (preferably a substituted or unsubstituted alkenyl group having from 2 to 30 carbon atoms, e.g., vinyl, allyl, prenyl, geranyl, oleyl), a cycloalkenyl group (preferably a substituted or unsubstituted cycloalkenyl group having from 3 to 30 carbon atoms, namely, a monovalent group resulting from removing one hydrogen atom from cycloalkane having from 3 to 30 carbon atoms, e.g., 2-cyclopenten-1-yl, 2-cyclohexen-1-yl) and a bicycloalkenyl group (a substituted or unsubstituted bicycloalkenyl group having, preferably a substituted or unsubstituted bicycloalkenyl group having from 5 to 30 carbon atoms, namely, a monovalent group resulting from removing one hydrogen atom from bicycloalkane having one double bond, e.g., bicyclo[2,2,1]hept-2-en-1-yl, bicyclo[2,2,2]oct-2-en-4-yl)]; an alkynyl group (preferably a substituted or unsubstituted alkynyl group having from 2 to 30 carbon atoms, e.g., ethynyl, propargyl, trimethylsilylethynyl); an aryl group (preferably a substituted or unsubstituted aryl group having from 6 to 30 carbon atoms, e.g., phenyl, p-tolyl, naphthyl, m-chlorophenyl, o-hexadecanoylaminophenyl); a heterocyclic group (preferably a monovalent group resulting from removing one hydrogen atom from a 5- or 6-membered substituted or unsubstituted, aromatic or non-aromatic heterocyclic compound, more preferably a 5- or 6-membered aromatic heterocyclic group having from 3 to 30 carbon atoms, e.g., 2-furyl, 2-thienyl, 2-pyrimidinyl, 2-benzothiazolyl); a cyano group; a hydroxyl group; a nitro group; a carboxyl group; an alkoxy group (preferably a substituted or unsubstituted alkoxy group having from 1 to 30 carbon atoms, e.g., methoxy, ethoxy, isopropoxy, tert-butoxy, n-octyloxy, 2-methoxyethoxy); an aryloxy group (preferably a substituted or unsubstituted aryloxy group having from 6 to 30 carbon atoms, e.g., phenoxy, 2-methylphenoxy, 4-tert-butylphenoxy, 3-nitrophenoxy, 2-tetradecanoylaminophenoxy); a silyloxy group (preferably a silyloxy group having from 3 to 20 carbon atoms, e.g., trimethylsilyloxy, tert-butyldimethyl-silyloxy); a heterocyclic oxy group (preferably a substituted or unsubstituted heterocyclic oxy group having from 2 to 30 carbon atoms, e.g., 1-phenyltetrazol-5-oxy, 2-tetrahydropyranyloxy); an acyloxy group (preferably a formyloxy group, a substituted or unsubstituted alkylcarbonyloxy group having from 2 to 30 carbon atoms, and a substituted or unsubstituted arylcarbonyloxy group having from 6 to 30 carbon atoms, e.g., formyloxy, acetyloxy, pivaloyloxy, stearoyloxy, benzoyloxy, p-methoxyphenylcarbonyloxy); a carbamoyloxy group (preferably a substituted or unsubstituted carbamoyloxy group having from 1 to 30 carbon atoms, e.g., N,N-dimethylcarbamoyloxy, N,N-diethylcarbamoyloxy, morpholinocarbonyloxy, N,N-di-n-octylaminocarbonyloxy, N-n-octylcarbamoyloxy); an alkoxycarbonyloxy group (preferably a substituted or unsubstituted alkoxycarbonyloxy group having from 2 to 30 carbon atoms, e.g., methoxycarbonyloxy, ethoxycarbonyloxy, tert-butoxycarbonyloxy, n-octylcarbonyloxy); an aryloxycarbonyloxy group (preferably a substituted or unsubstituted aryloxycarbonyloxy group having from 7 to 30 carbon atoms, e.g., phenoxycarbonyloxy, p-methoxyphenoxycarbonyloxy, p-n-hexadecyloxyphenoxycarbonyloxy); an amino group (preferably an amino group, a substituted or unsubstituted alkylamino group having from 1 to 30 carbon atoms, and a substituted or unsubstituted anilino group having from 6 to 30 carbon atoms, e.g., amino, methylamino, dimethylamino, anilino, N-methylanilino, diphenylamino); an acylamino group (preferably a formyl group, a substituted or unsubstituted alkylcarbonylamino group having from 1 to 30 carbon atoms, and a substituted or unsubstituted arylcarbonylamino group having from 6 to 30 carbon atoms, e.g., formylamino, acetylamino, pivaloylamino, lauroylamino, benzoylamino, 3,4,5-tri-n-octyloxyphenylcarbonylamino); an aminocarbonylamino group (preferably a substituted or unsubstituted aminocarbonylamino group having from 1 to 30 carbon atoms, e.g., carbamoylamino, N,N-dimethylaminocarbonylamino, N,N-diethylaminocarbonylamino, morpholinocarbonylamino); an alkoxycarbonylamino group (preferably a substituted or unsubstituted alkoxycarbonylamino group having from 2 to 30 carbon atoms, e.g., methoxycarbonylamino, ethoxycarbonylamino, tert-butoxycarbonylamino, n-octadecyloxycarbonylamino, N-methylmethoxycarbonylamino); an aryloxycarbonylamino group (preferably a substituted or unsubstituted aryloxycarbonylamino group having from 7 to 30 carbon atoms, e.g., phenoxycarbonylamino, p-chlorophenoxycarbonylamino, m-n-octyloxyphenoxycarbonylamino); a sulfamoylamino group (preferably a substituted or unsubstituted sulfamoylamino group having from 0 to 30 carbon atoms, e.g., sulfamoylamino, N,N-dimethylaminosulfonylamino, N-n-octylaminosulfonylamino); an alkyl- or aryl-sulfonylamino group (preferably a substituted or unsubstituted alkylsulfonylamino group having from 1 to 30 carbon atoms and a substituted or unsubstituted arylsulfonylamino group having from 6 to 30 carbon atoms, e.g., methylsulfonylamino, butylsulfonylamino, phenylsulfonylamino, 2,3,5-trichlorophenylsulfonylamino, p-methylphenylsulfonylamino); a mercapto group; an alkylthio group (preferably a substituted or unsubstituted alkylthio group having from 1 to 30 carbon atoms, e.g., methylthio, ethylthio, n-hexadecylthio); an arylthio group (preferably a substituted or unsubstituted arylthio group having from 6 to 30 carbon atoms, e.g., phenylthio, p-chlorophenylthio, m-methoxyphenylthio); a heterocyclic thio group (preferably a substituted or unsubstituted heterocyclic thio group having from 2 to 30 carbon atoms, e.g., 2-benzothiazolylthio, 1-phenyltetrazol-5-ylthio); a sulfamoyl group (preferably a substituted or unsubstituted sulfamoyl group having from 0 to 30 carbon atoms, e.g., N-ethylsulfamoyl, N-(3-dodecyloxypropyl)sulfamoyl, N,N-dimethylsulfamoyl, N-acetylsulfamoyl, N-benzoylsulfamoyl, N-(N'-phenylcarbamoyl)sulfamoyl); a sulfo group; an alkyl- or arylsulfinyl group (preferably a substituted or unsubstituted alkylsulfinyl group having from 1 to 30 carbon atoms and a substituted or unsubstituted arylsulfinyl group having from 6 to 30 carbon atoms, e.g., methylsulfinyl, ethylsulfinyl, phenylsulfinyl, p-methylphenylsulfinyl); an alkyl- or arylsulfonyl group (preferably a substituted or unsubstituted alkylsulfonyl group having from 1 to 30 carbon atoms and a substituted or unsubstituted arylsulfonyl group having from 6 to 30 carbon atoms, e.g., methylsulfonyl, ethylsulfonyl, phenylsulfonyl, p-methylphenylsulfonyl); an acyl group (preferably a formyl group, a substituted or unsubstituted alkylcarbonyl group having from 2 to 30 carbon atoms, a substituted or unsubstituted arylcarbonyl group having from 7 to 30 carbon atoms, and a substituted or unsubstituted heterocyclic carbonyl group having from 4 to 30 carbon atoms in which the carbonyl group is bonded through a carbon atoms, e.g., acetyl, pivaloyl, 2-chloroacetyl, stearoyl, benzoyl, p-n-octyloxyphenylcarbonyl, 2-pyridylcarbonyl, 2-furylcarbonyl); an aryloxycarbonyl group (preferably a substituted or unsubstituted aryloxycarbonyl group having from 7 to 30 carbon atoms, e.g., phenoxycarbonyl, o-chlorophenoxycarbonyl, m-nitrophenoxycarbonyl, p-tert-butylphenoxycarbonyl); an alkoxycarbonyl group (preferably a substituted or unsubstituted alkoxycarbonyl group having from 2 to 30 carbon atoms, e.g., methoxycarbonyl, ethoxycarbonyl, tert-butoxycarbonyl, n-octadecyloxycarbonyl); a carbamoyl group (preferably a substituted or unsubstituted carbamoyl group having from 1 to 30 carbon atoms, e.g., carbamoyl, N-methylcarbamoyl, N,N-dimethylcarbamoyl, N,N-di-n-octylcarbamoyl, N-(methylsulfonyl)carbamoyl); an aryl- or heterocyclic-azo group (preferably a substituted or unsubstituted arylazo group having from 6 to 30 carbon atoms and a substituted or unsubstituted heterocyclic azo group having from 3 to 30 carbon atoms, e.g., phenylazo, p-chlorophenylazo, 5-ethylthio-1,3,4-thiadiazol-2-ylazo); an imido group (preferably N-succinimido and N-phthalimido); a phosphino group (preferably a substituted or unsubstituted phosphino group having from 2 to 30 carbon atoms, e.g., dimethylphosphino, diphenylphosphino, methylphenoxyphosphino); a phosphinyl group (preferably a substituted or unsubstituted phosphinyl group having from 2 to 30 carbon atoms, e.g., phosphinyl, dioctyloxyphosphinyl, diethoxyphosphinyl); a phosphinyloxy group (preferably a substituted or unsubstituted phosphinyloxy group having from 2 to 30 carbon atoms, e.g., diphenoxyphosphinyloxy, dioctyloxyphosphinyloxy); a phosphinylamino group (preferably a substituted or unsubstituted phosphinylamino group having from 2 to 30 carbon atoms, e.g., dimethoxyphosphinylamino, dimethylaminophosphinylamino); and a silyl group (preferably a substituted or unsubstituted silyl group having from 3 to 30 carbon atoms, e.g., trimethylsilyl, tert-butyldimethylsilyl, phenyldimethylsilyl). Among these substituent, when the substituent has a hydrogen atom, the hydrogen atom may be displaced by the above-described substituent. Examples of the substituent where the hydrogen atom is displaced by the above-described substituent include an alkylcarbonylaminosulfonyl group, an arylcarbonylaminosulfonyl group, an alkylsulfonylaminocarbonyl group and an arylsulfonylaminocarbonyl group. Specific examples thereof include methylsulfonylaminocarbonyl, p-methylphenylsulfonylaminocarbonyl, acetylaminosulfonyl and benzoylaminosulfonyl. Here, these substituents are called the substituent V. The substituent V may be further substituent.

The substituent represented by $R_{10}$, $R_{11}$, $R_{12}$, $R_{13}$ and $R_{14}$ is preferably an alkyl group, an aryl group, a halogen atom, a cyano group, a nitro group, a hydroxy group, an acyl group, an alkoxy group, an alkylthio group, a carbamoyl group, a sulfamoyl group, an amino group, an acylamino group, an acyloxy group, a carboxy group or a mercapto group, more preferably an alkyl group, a halogen atom, a cyano group, a hydroxy group, an acyl group, an alkoxy group, a carbamoyl group, an amino group or an acylamino group, still more preferably an alkyl group.

$R_{10}$, $R_{11}$, $R_{12}$, $R_{13}$ and $R_{14}$ each is preferably a hydrogen atom or an alkyl group having from 1 to 3 carbon atoms, more preferably a hydrogen atom.

In formula (IV), $Y_1$, $Y_2$, $Y_3$, $Y_4$ and $Y_5$ each represents a hydrogen atom or a substituent, provided that at least one of $Y_1$, $Y_2$, $Y_3$, $Y_4$ and $Y_5$ is a group selected from the group consisting of $—SO_2NH_2$, $—SO_2NHR_{15}$, $—SO_2N(R_{15})_2$, $—SO_3^-$, $—CONH_2$, $—CONHR_{15}$, $—CON(R_{15})_2$, $—NHSO_2NH_2$, $—NHSO_2NHR_{15}$, $—NHSO_2N(R_{15})_2$ and $—SO_2NHCOR_{15}$. These groups are called the substituent Z.

Examples of the substituent represented by $Y_1$, $Y_2$, $Y_3$, $Y_4$ and $Y_5$ include the substituent V described above as the substituent represented by $R_{10}$, $R_{11}$, $R_{12}$, $R_{13}$ and $R_{14}$. However, at least one of $Y_1$, $Y_2$, $Y_3$, $Y_4$ and $Y_5$ is a group selected from the substituent Z. Among the substituent V, the substituent represented by $Y_1$, $Y_2$, $Y_3$, $Y_4$ and $Y_5$ is preferably a linear, branched or cyclic alkyl group having from 1 to 20 carbon atoms (e.g., methyl, ethyl, isopropyl, tert-butyl, n-octyl, n-decyl, n-hexadecyl, cyclopropyl, cyclopentyl, cyclohexyl), a halogen atom (e.g., F, Cl, Br, I), a cyano group, a nitro group, a hydroxy group, an acyl group, an alkoxy group, an alkylthio group, a carbamoyl group, a sulfamoyl group, a sulfo group, an aminosulfonylamino group, an acylaminosulfonyl group, an amino group, an acylamino group, an acyloxy group, a carboxy group or a mercapto group, more preferably an alkyl group, a halogen atom, a cyano group, a carbamoyl group, a sulfamoyl group, a sulfo group, an aminosulfonylamino group, an acylaminosulfonyl group, an acyl group, an alkoxy group, a carbamoyl group, an amino group or an acylamino group, more preferably an alkyl group, a halogen atom, an acyl group, an alkoxy group, a carbamoyl group, a sulfamoyl group, a sulfo group, an aminosulfonylamino group, an acylaminosulfonyl group, an amino group or an acylamino group, still more preferably an alkyl group.

$Y_1$, $Y_2$, $Y_3$, $Y_4$ and $Y_5$ each is preferably a hydrogen atom or a substituent described above as preferred examples of the substituent represented by $Y_1$ to $Y_5$, more preferably a hydrogen atom. However, at least one of $Y_1$ to $Y_5$ is the substituent Z.

Among the substituent Z, preferred are $—SO_2NH_2$, $—SO_2NHR_{15}$ and $—SO_2NHCOR_{15}$, preferred are $—SO_2NH_2$ and $—SO_2NHCOR_{15}$, still more preferred is $—SO_2NH_2$.

Out of $Y_1$, $Y_2$, $Y_3$, $Y_4$ and $Y_5$, preferably three or less, more preferably two or less, most preferably one, are(is) the substituent Z. The position to which the substituent Z is substituted is preferably $Y_1$ or $Y_3$, more preferably $Y_3$.

$R_{15}$ represents a substituted or unsubstituted alkyl group, a substituted or unsubstituted alkenyl group, a substituted or unsubstituted alkynyl group or a substituted or unsubstituted aryl group, preferably an alkyl group, more preferably an unsubstituted alkyl group having from 1 to 10 carbon atoms, such as methyl, ethyl propyl.

In formula (IV), $n_a$ is a number necessary for neutralizing the electric charge of the compound and usually represents a number of 0 to 3. $n_a$ is not necessarily an integer but may be a fraction or a decimal.

In formula (IV), $X^-$ represents a counter anion and the meaning and preferred examples thereof are the same as $X^-$ in formula (I).

The compound represented by formula (IV) is preferably the compound represented by the following formula (IV-A), more preferably the compound represented by the following formula (IV-B):

(IV-A)

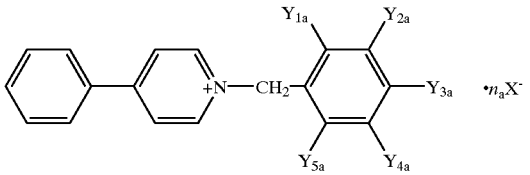

wherein $Y_{1a}$, $Y_{2a}$, $Y_{4a}$ and $Y_{5a}$ each represents a hydrogen atom, a substituent represented by $Y_1$ to $Y_5$ of formula (IV), or the substituent Z, $Y_{3a}$ represents a group selected from the group consisting of $—SO_2NH_2$, $—SO_2NHR_{15}$, $—SO_2N(R_{15})_2$, $—SO_3^-$, $—CONH_2$, $—CONHR_{15}$, $—CON(R_{15})_2$, $—NHSO_2NH_2$, $—NHSO_2NHR_{15}$, $—NHSO_2N(R_{15})_2$ and $—SO_2NHCOR_{15}$, and $R_{15}$, $n_a$ and $X^-$ have the same meanings as in formula (IV);

(IV-B)

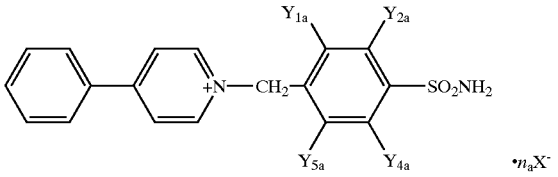

wherein $Y_{1a}$, $Y_{2a}$, $Y_{4a}$ and $Y_{5a}$ have the same meanings as $Y_{1a}$, $Y_{2a}$, $Y_{4a}$ and $Y_{5a}$ in formula (IV-A) and preferred ranges thereof are also the same, and $n_a$ and $X^-$ have the same meanings as in formula (IV).

The compound represented by (V) is described in detail below. Among the compounds represented by formula (III), the compound represented by the following formula (V) is preferred in view of the objects of the present invention:

(V)

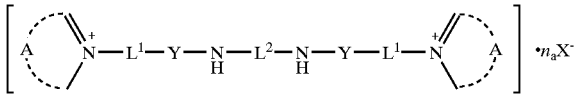

wherein A represents an organic residue for completing the nitrogen-containing aromatic heterocyclic ring, $L^1$ and $L^2$ each represents a divalent linking group, Y represents $—C(=O)—$, $—SO_2—$, $—NHC(=O)—$ or $—NHC(=S)—$, $X^-$ and $n_a$ have the same meaning as in formula (IV), In formula (V), $L^1$ represents a divalent linking group. Examples of the divalent linking group include the linking groups constituted by any one or a combination of two or more of an alkylene group, an arylene group and an alkenylene group. The alkylene group represented by $L^1$ may be a linear or branched alkylene group or may contain a cyclic structure and is preferably an alkylene group having from 1 to 20 carbon atoms (e.g., methylene, ethylene, trimethylene, propylene). The arylene group is preferably an arylene group having from 8 to 20 carbon atoms (e.g., $—CH_2C_6H_4CH_2—$). The alkenylene group is preferably an alkenylene group having from 2 to 20 carbon atoms (e.g., $—CH_2CH=CHCH_2—$). The linking group constituted by a combination thereof is preferably a linking group having from 3 to 20 carbon atoms. $L^1$ may have a substituent and examples of the substituent include the substituent V. Among the substituent V, the substituent of $L^1$ is preferably an alkyl group or an aryl group.

$L^1$ is preferably a substituted or unsubstituted alkylene group having from 1 to 10 carbon atoms, more preferably a substituted or unsubstituted methylene, ethylene or trimethylene group, still more preferably an unsubstituted methylene or ethylene group, and most preferably an unsubstituted methylene group.

In formula (V), $L^2$ represents a divalent linking group. Examples of the divalent linking group include linking groups constituted by a combination of an alkylene group having from 1 to 20 carbon atoms, an arylene group having from 6 to 18 carbon atoms, an alkenylene group having from 2 to 20 carbon atoms or an alkylene group having from 2 to 20 carbon atoms with any one or a combination of two or more of $—SO_2—$, —SO—, —O—, —S—, —CO—, —NH—, $—N(R_{16})—$ (wherein $R_{16}$ represents a substituted or unsubstituted alkyl, alkenyl, aralkyl or aryl group), $—P(=O)=$ and a cationic group (specifically, a quaternary salt structure of nitrogen or phosphorus, or a nitrogen-containing heterocyclic ring containing a quaternized nitrogen atom). The divalent linking group represented by $L^2$ is preferably a linking group constituted by a combination of an alkylene group having from 1 to 16 carbon atoms or an alkylene group having from 2 to 16 carbon atoms with —O— or —S—, more preferably a combination of an alkylene group having from 1 to 12 carbon atoms or an alkylene group having from 2 to 12 carbon atoms with —O—, still more preferably a combination of an alkylene group having from 2 to 10 carbon atoms with —O—. Specific examples thereof include diethyleneoxy and triethyleneoxy.

$R_{16}$ represents a substituted or unsubstituted alkyl, alkenyl, alkynyl or aryl group, preferably an alkyl group, more preferably an unsubstituted alkyl group having from 1 to 10 carbon atoms, such as methyl, ethyl or propyl.

In formula (V), Y represents $—C(=O)—$, $—SO_2—$, $—NHC(=O)—$ or $—NHC(=S)—$, preferably $—C(=O)—$ or $—SO_2—$, more preferably $—C(=O)—$.

In formula (V), A represents an organic residue for completing the nitrogen-containing heterocyclic ring. The nitrogen-containing heterocyclic compound as used herein includes pyridine derivatives, quinoline derivatives, isoquinoline derivatives, pyrrole derivatives, oxazole derivatives, thiazole derivatives, imidazole derivatives, benzoxazole derivatives, benzothiazole derivatives and benzimidazole derivatives, and may be a monocyclic compound or may be a compound condensed with another ring. Also, this heterocyclic compound may have a substituent and examples of the substituent include the substituent V. Among the substituent V, preferred are an alkyl group, an alkenyl group, an alkynyl group, an aryl group, a heterocyclic ring group, an acyloxy group, a halogen atom, an alkoxy group, an aryloxy group, an alkylthio group, an arylthio group, an acyl group, an (alkyl- or aryl-)oxycarbonyl group, a sulfo group (including sulfonate), a carboxy group (including carboxylate), a mercapto group, a carbonamide group, a sulfonamide group, a sulfamoyl group, a carbamoyl group, a ureido group, a thioureido group, (an (alkyl- or aryl-) amino group), a cyano group and a nitro group. These substituents each may be further substituted by another substituent. The substituent of the aromaheterocyclic compound is preferably an alkyl group, an aryl group, a heterocyclic group, a halogen atom, an alkoxy group, an aryloxy group, an alkylthio group, an arylthio group, an alkyl- or aryl-amino group, or a cyano group.

In formula (V), the aromatic heterocyclic compound formed by A is preferably a pyridine derivative, a quinoline derivative, an isoquinoline derivative, a benzoxazole derivative, a benzothiazole derivative or a benzimidazole derivative, more preferably a pyridine derivative, a quinoline derivative or an isoquinoline derivative, still more preferably 4-phenylpyridine, isoquinoline or quinoline, and particularly preferably 4-phenylpyridine.

The compound represented by formula (V) is more preferably a compound represented by the following formula (V-A), more preferably a compound represented by the following formula (V-B):

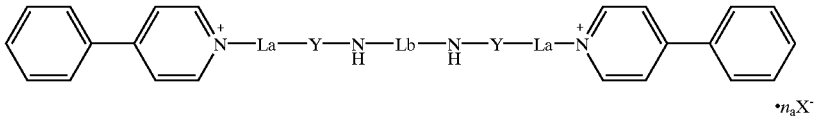

(V-A)

wherein La represents a divalent linking group constituted by any one or a combination of two or more of an alkylene group, an arylene group and an alkenylene group, Lb represents a divalent group constituted by any one or a combination of two or more of an alkylene group, an arylene group, an alkenylene group, —$SO_2$—, —SO—, —O—, —S—, —CO—, —NH— and —N($R_{16}$)—, $R_{16}$ represents an alkyl group, an alkenyl group, an aralkyl group or an aryl group, Y has the same meaning as Y in formula (V), and $n_a$ and $X^-$ have the same meanings as in formula (IV);

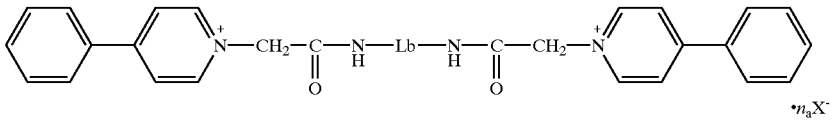

(V-B)

wherein Lb has the same meaning as Lb in formula (V-A), and $n_a$ and $X^-$ have the same meanings as in formula (IV).

La represents a divalent linking group constituted by any one or a combination of two or more of an alkylene group, an arylene group and an alkenylene group, preferably an alkylene group having from 1 to 20 carbon atoms or an alkenylene group having from 2 to 20 carbon atoms, more preferably an alkylene group having from 1 to 4 carbon atoms or an alkenylene group having from 2 to 4 carbon atoms, still more preferably methylene, ethylene or trimethylene.

Lb represents preferably an alkylene group having from 1 to 20 carbon atoms or a combination of an alkylene group having from 2 to 20 carbon atoms with —$SO_2$—, —SO—, —O—, —S—, —CO— or —NH—, preferably an alkylene group having from 1 to 10 carbon atoms or a combination of an alkylene group having from 2 to 10 carbon atoms with —O— or —S—, more preferably an alkylene group having from 1 to 12 carbon atoms or a combination of an alkylene group having from 2 to 12 carbon atoms with —O—. Specific examples thereof include diethyleneoxy and triethyleneoxy.

Specific examples of the compounds represented by formulae (IV) and (V) are set forth below, however, the present invention is not limited thereto.

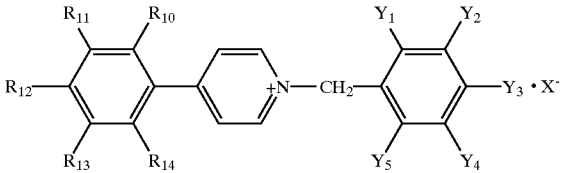

| No | $R_{10}$ | $R_{11}$ | $R_{12}$ | $R_{13}$ | $R_{14}$ | $Y_1$ | $Y_2$ | $Y_3$ | $Y_4$ | $Y_5$ | X |
|---|---|---|---|---|---|---|---|---|---|---|---|
| IV-1 | —H | —H | —H | —H | —H | —H | —H | —$SO_2NH_2$ | —H | —H | Cl |
| IV-2 | —H | —H | —H | —H | —H | —H | —$SO_2NH_2$ | —H | —H | —H | Cl |
| IV-3 | —H | —H | —H | —H | —H | —$SO_2NH_2$ | —H | —H | —H | —H | Cl |
| IV-4 | —H | —H | —H | —H | —H | —H | —H | —$SO_2NHCOCH_3$ | —H | —H | Cl |
| IV-5 | —H | —H | —H | —H | —H | —H | —$SO_2NHCOCH_3$ | —H | —H | —H | Cl |
| IV-6 | —H | —H | —H | —H | —H | —$SO_2NHCOCH_3$ | —H | —H | —H | —H | Cl |
| IV-7 | —H | —H | —H | —H | —H | —H | —$SO_2NH_2$ | —H | —$SO_2NH_2$ | —H | Cl |
| IV-8 | —H | —H | —H | —H | —H | —$SO_2NH_2$ | —H | —$SO_2NH_2$ | —H | —H | Cl |
| IV-9 | —H | —H | —H | —H | —H | —$SO_2NH_2$ | —H | —$SO_2NH_2$ | —$SO_2NH_2$ | —H | Cl |
| IV-10 | —H | —H | —H | —H | —H | —H | —$SO_2NHCOCH_3$ | —H | —$SO_2NHCOCH_3$ | —H | Cl |
| IV-11 | —H | —H | —H | —H | —H | —$SO_2NHCOCH_3$ | —H | —$SO_2NHCOCH_3$ | —H | —H | Cl |
| IV-12 | —H | —H | —H | —H | —H | —H | —$SO_2NHCOC_4H_9$ | —H | —$SO_2NHCOC_4H_9$ | —H | Br |
| IV-13 | —H | —H | —$CH_3$ | —H | —H | —H | —H | —$SO_2NH_2$ | —H | —H | Br |
| IV-14 | —H | —Ph | —H | —H | —H | —H | —$SO_2NHCOCH_3$ | —H | —$SO_2NHCOCH_3$ | —H | Cl |
| IV-15 | —H | —$CH_3$ | —$CH_3$ | —H | —H | —H | —H | —$SO_2NH_2$ | —H | —H | I |
| IV-16 | —H | —H | —H | —H | —H | —H | —H | —$CONH_2$ | —H | —H | Cl |
| IV-17 | —H | —H | —H | —H | —H | —H | —H | —$SO_2N(CH_3)_2$ | —H | —H | Ts |
| IV-18 | —H | —H | —H | —H | —H | —H | —$CONHCH_3$ | —H | —$CONHCH_3$ | —H | $1/2SO_4^{2-}$ |
| IV-19 | —H | —H | —H | —H | —H | —H | —$SO_2NHC_3H_7$ | —H | —H | —H | Br |
| IV-20 | —H | —H | —H | —H | —H | —H | —H | —$NHSO_2NHCH_3$ | —H | —H | Br |
| IV-21 | —H | —H | —H | —H | —H | —H | —H | —$SO_3^-$ | —H | —H | — |
| IV-22 | —H | —H | —H | —H | —H | —$CH_3$ | —H | —$SO_2NH_2$ | —H | —$CH_3$ | Cl |
| IV-23 | —H | —H | —H | —H | —H | —Cl | —H | —$SO_2NH_2$ | —H | —Cl | Cl |
| IV-24 | —H | —H | —H | —H | —H | —H | —Cl | —$CO_2NHCOCH_3$ | —H | —H | Cl |
| IV-25 | —H | —H | —H | —H | —H | —H | —$CH_3$ | —$SO_2NH_2$ | —H | —H | Cl |
| IV-26 | —H | —$CH_3$ | —H | —$CH_3$ | —H | —H | —$CH_3$ | —$SO_2NH_2$ | —$CH_3$ | —H | Cl |
| IV-27 | —H | —H | —Ph | —H | —H | —$SO_2NHCOC_2H_5$ | —H | —$CH_3$ | —H | —H | Br |
| IV-28 | —H | —H | —H | —H | —H | —H | —$CONH_2$ | —H | —$CONH_2$ | —H | Cl |
| IV-29 | —H | —H | —Cl | —H | —H | —H | —H | —$SO_2NH_2$ | —H | —H | Cl |
| IV-30 | —H | —H | —$SCH_3$ | —H | —H | —H | —H | —$SO_2NH_2$ | —H | —H | Cl |
| IV-31 | —H | —H | —$OCH_3$ | —H | —H | —H | —H | —$SO_2NH_2$ | —H | —H | Cl |
| IV-32 | —H | —H | —$COCH_3$ | —H | —H | —H | —H | —$SO_2NH_2$ | —H | —H | Cl |
| IV-33 | —H | —H | —CN | —H | —H | —H | —H | —$SO_2NH_2$ | —H | —H | Cl |
| IV-34 | —H | —H | —$CO_2H$ | —H | —H | —H | —H | —$SO_2NH_2$ | —H | —H | Cl |
| IV-35 | —H | —H | —$NO_2$ | —H | —H | —H | —H | —$SO_2NH_2$ | —H | —H | Cl |
| IV-36 | —H | —$CONH_2$ | —H | —H | —H | —H | —H | —$SO_2NH_2$ | —H | —H | Cl |
| IV-37 | —H | —H | —H | —H | —H | —$CH_3$ | —H | —$SO_2NH_2$ | —H | —H | Cl |
| IV-38 | —H | —H | —H | —H | —H | —$CH_2CH_3$ | —H | —$SO_2NH_2$ | —H | —H | Cl |
| IV-39 | —H | —H | —H | —H | —H | —$CH(CH_3)_2$ | —H | —$SO_2NH_2$ | —H | —H | Cl |

-continued

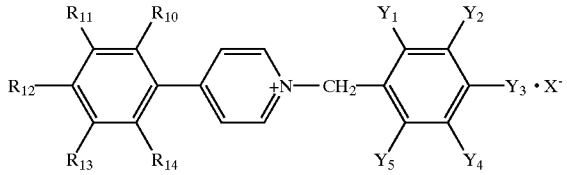

| No | $R_{10}$ | $R_{11}$ | $R_{12}$ | $R_{13}$ | $R_{14}$ | $Y_1$ | $Y_2$ | $Y_3$ | $Y_4$ | $Y_5$ | X |
|---|---|---|---|---|---|---|---|---|---|---|---|
| IV-40 | —H | —H | —H | —H | —H | —$CH_2CH{=}CH_2$ | —H | —$SO_2NH_2$ | —H | —H | Cl |
| IV-41 | —H | —H | —H | —H | —H | —$NO_2$ | —H | —$SO_2NH_2$ | —H | —H | Cl |
| IV-42 | —H | —H | —H | —H | —H | —I | —H | —$SO_2NH_2$ | —H | —I | Cl |
| IV-43 | —H | —H | —H | —H | —H | —I | —H | —$SO_2NH_2$ | —H | —H | Cl |
| IV-44 | —H | —H | —H | —H | —H | —Br | —H | —$SO_2NH_2$ | —H | —H | Cl |
| IV-45 | —H | —H | —H | —H | —H | —Cl | —H | —$SO_2NH_2$ | —H | —H | Cl |
| IV-46 | —H | —H | —H | —H | —H | —OH | —H | —$SO_2NH_2$ | —H | —H | Cl |
| IV-47 | —H | —H | —H | —H | —H | —$OCH_3$ | —H | —$SO_2NH_2$ | —H | —H | Cl |
| IV-48 | —H | —H | —H | —H | —H | —$OCH_2CH_3$ | —H | —$SO_2NH_2$ | —H | —H | Cl |
| IV-49 | —H | —H | —H | —H | —H | —SH | —H | —$SO_2NH_2$ | —H | —H | Cl |
| IV-50 | —H | —H | —H | —H | —H | —$SCH_3$ | —H | —$SO_2NH_2$ | —H | —H | Cl |
| IV-51 | —H | —H | —H | —H | —H | —$COCH_3$ | —H | —$SO_2NH_2$ | —H | —H | Cl |
| IV-52 | —H | —H | —H | —H | —H | —$NHCOCH_3$ | —H | —$SO_2NH_2$ | —H | —H | Cl |
| IV-53 | —H | —H | —H | —H | —H | —$CO_2H$ | —H | —$SO_2NH_2$ | —H | —H | Cl |
| IV-54 | —H | —H | —H | —H | —H | —$SO_3^-$ | —H | —$SO_2NH_2$ | —H | —H | Cl |
| IV-55 | —H | —H | —H | —H | —H | —$N(CH_3)_2$ | —H | —$SO_2NH_2$ | —H | —H | Cl |
| IV-56 | —H | —H | —H | —H | —H | —$NHCH_3$ | —H | —$SO_2NH_2$ | —H | —H | Cl |
| IV-57 | —H | —H | —H | —H | —H | —$COOCH_3$ | —H | —$SO_2NH_2$ | —H | —H | Cl |
| IV-59 | —H | —H | —H | —H | —H | —H | —H | —$CONHCH_3$ | —H | —H | Cl |
| IV-60 | —H | —H | —H | —H | —H | —H | —H | —$NH_2SO_2NH_2$ | —H | —H | Cl |

Ph = Phenyl group
Ts = Tosylate

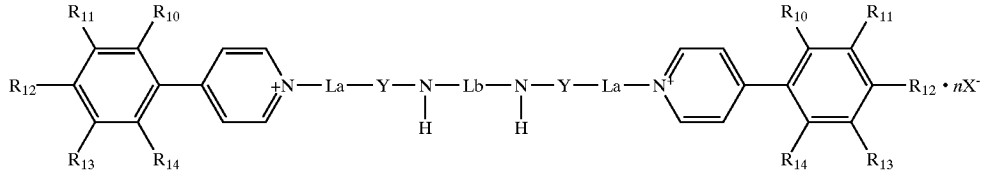

| No | $R_{10}$ | $R_{11}$ | $R_{12}$ | $R_{13}$ | $R_{14}$ | La | Lb | Y | nX |
|---|---|---|---|---|---|---|---|---|---|
| V-1 | —H | —H | —H | —H | —H | —$CH_2$— | —$CH_2CH_2CH_2$—O—$CH_2CH_2$—O—$CH_2CH_2CH_2$— | —CO— | 2Cl |
| V-2 | —H | —H | —H | —H | —H | —$CH_2$— | —$CH_2CH_2$—O—$CH_2CH_2$—O—$CH_2CH_2$— | —CO— | 2Cl |
| V-3 | —H | —H | —H | —H | —H | —$CH_2$— | —$CH_2CH_2$—O—$CH_2CH_2$—O—$CH_2CH_2$—O—$CH_2CH_2$— | —CO— | 2Br |
| V-4 | —H | —H | —H | —H | —H | —$CH_2CH_2$— | —$CH_2CH_2CH_2$—O—$CH_2CH_2$—O—$CH_2CH_2CH_2$— | —CO— | 2Br |
| V-5 | —H | —H | —H | —H | —H | —$CH_2CH_2$— | —$CH_2CH_2$—O—$CH_2CH_2$—O—$CH_2CH_2$—O—$CH_2CH_2$— | —CO— | 2Cl |
| V-6 | —H | —H | —H | —H | —H | —$CH_2CH_2$— | —$CH_2CH_2CH_2$—O—$CH_2CH_2CH_2$— | —CO— | 2Br |
| V-7 | —H | —H | —H | —H | —H | —$CH_2$— | —$CH_2CH_2$—S—$CH_2CH_2$—S—$CH_2CH_2$— | —CO— | 2Cl |
| V-8 | —H | —H | —H | —H | —H | —$CH_2CH_2$— | —$CH_2CH_2$—S—$CH_2CH_2$—S—$CH_2CH_2$—S—$CH_2CH_2$— | —CO— | 2I |
| V-9 | —H | —H | —H | —H | —H | —$CH_2CH_2CH_2$— | —$CH_2CH_2CH_2$—S—$CH_2CH_2CH_2$— | —CO— | 2Cl |
| V-10 | —H | —H | —H | —H | —H | -p-Ph— | —$CH_2CH_2CH_2$—O—$CH_2CH_2$—O—$CH_2CH_2CH_2$— | —CO— | 2Cl |
| V-11 | —H | —H | —H | —H | —H | —$CH_2CH_2$— | —$CH_2CH_2$—O—$CH_2CH_2$—O—$CH_2CH_2$— | —$SO_2$— | 2Br |
| V-12 | —H | —H | —H | —H | —H | —$CH_2CH_2CH_2$— | —$CH_2CH_2$—S—$CH_2CH_2$—S—$CH_2CH_2$— | —$SO_2$— | 2Ts |
| V-13 | —H | —H | —$CH_3$ | —H | —H | —$CH_2CH_2CH_2$— | —$CH_2CH_2CH_2$—O—$CH_2CH_2$—O—$CH_2CH_2CH_2$— | —CO— | $SO_4^{2-}$ |
| V-14 | —H | —$CH_3$ | —H | —$CH_3$ | —H | —$CH_2CH_2CH_2$— | —$CH_2CH_2CH_2$—S—$CH_2CH_2CH_2$— | —$SO_2$— | 2Cl |
| V-15 | —$CH_3$ | —H | —H | —H | —$CH_3$ | —$CH_2CH_2CH_2$— | —$CH_2CH_2CH_2$—S—$CH_2CH_2CH_2$— | —CO— | 2Cl |
| V-16 | —H | —H | —H | —H | —H | —$CH_2$— | —$CH_2CH_2$—$SO_2$—$CH_2CH_2$—$SO_2$—$CH_2CH_2$— | —CO— | 2Cl |
| V-17 | —H | —H | —H | —H | —H | —$CH_2$— | —$CH_2CH_2$—NH—$CH_2CH_2$—NH—$CH_2CH_2$— | —CO— | 2Cl |
| V-18 | —H | —H | —H | —H | —H | —$CH_2$— | —$CH_2CH_2$—O—$CH_2CH_2$— | —CO— | 2Cl |
| V-19 | —H | —H | —H | —H | —H | —$CH_2$— | —$CH_2CH_2$—O—$CH_2CH_2$—O—$CH_2CH_2$—O—$CH_2CH_2$— | —CO— | 2Cl |
| V-20 | —H | —H | —H | —H | —H | —$CH_2$— | —$CH(CH_2)CH_2$—O—$CH_2CH_2$—O—$CH_2CH(CH_3)$— | —CO— | 2Cl |
| V-21 | —H | —H | —H | —H | —H | —$CH_2$— | —$CH_2CH_2$—O—$CH(CH_3)CH_2$— | —CO— | 2Cl |
| V-22 | —H | —H | —H | —H | —H | —$CH_2$— | —$CH_2CH_2$—O—$CH(CH_3)CH_2$—O—$CH(CH_3)CH_2$— | —CO— | 2Cl |
| V-23 | —H | —H | —H | —H | —H | —$CH_2$— | —$CH_2CH_2CH_2$—O—$CH_2CH_2CH_2$— | —CO— | 2Cl |
| V-24 | —H | —H | —H | —H | —H | —$CH_2$— | —$CH_2CO$— | —CO— | 2Cl |
| V-25 | —H | —H | —H | —H | —H | —$CH_2$— | —$CH_2$—CONH—$CH_2CO$— | —CO— | 2Cl |
| V-26 | —H | —H | —H | —H | —H | —$CH_2$— | —$CH_2CH_2CH_2$—NHCO—$CH_2$—CONH—$CH_2CH_2CH_2$— | —CO— | 2Cl |
| V-27 | —H | —H | —H | —H | —H | —$CH_2$— | —$CH_2CH_2$— | —CO— | 2Cl |
| V-28 | —H | —H | —H | —H | —H | —$CH_2$— | —$CH_2CH_2CH_2$— | —CO— | 2Cl |
| V-29 | —H | —H | —H | —H | —H | —$CH_2$— | —$CH_2CH_2CH_2CH_2$— | —CO— | 2Cl |
| V-30 | —H | —H | —H | —H | —H | —$CH_2$— | —$CH_2CH(CH_3)CH_2$— | —CO— | 2Cl |
| V-31 | —H | —H | —H | —H | —H | —$CH_2$— | 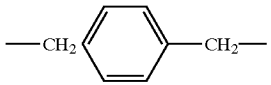 | —CO— | 2Cl |
| V-32 | —H | —H | —H | —H | —H | —$CH_2$— | —$CH_2CH_2CH_2$—N($CH_3$)—$CH_2CH_2CH_2$— | —CO— | 2Cl |
| V-33 | —H | —H | —H | —H | —H | —$CH_2$— | —$SO_2CH_2CH_2CH_2SO_2$— | —CO— | 2Cl |
| V-34 | —H | —H | —H | —H | —H | —$CH_2$— | —$CH_2CH_2$—S—S—$CH_2CH_2$— | —CO— | 2Cl |

-continued

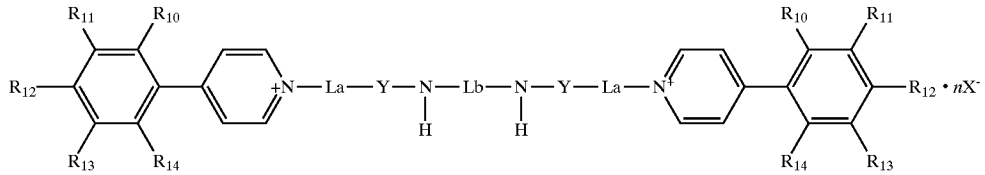

| No | $R_{10}$ | $R_{11}$ | $R_{12}$ | $R_{13}$ | $R_{14}$ | La | Lb | Y | nX |
|---|---|---|---|---|---|---|---|---|---|
| V-35 | —H | —H | —H | —H | —H | —$CH_2$— | —$CH_2CH{=}CHCH_2$— | —CO— | 2Cl |
| V-36 | —H | —H | —H | —H | —H | —CH(Ph)— | —$CH_2CH_2$—O—$CH_2CH_2$— | —CO— | 2Cl |
| V-37 | —H | —H | —H | —H | —H | —$CH(CH_3)$— | —$CH_2CH_2$—O—$CH_2CH_2$— | —CO— | 2Cl |
| V-38 | —H | —H | —CN | —H | —H | —$CH_2$— | —$CH_2CH_2$—O—$CH_2CH_2$— | —CO— | 2Cl |
| V-39 | —H | —H | —$CO_2CH_3$ | —H | —H | —$CH_2$— | —$CH_2CH_2$—O—$CH_2CH_2$— | —CO— | 2Cl |
| V-40 | —H | —H | —$N(CH_3)_2$ | —H | —H | —$CH_2$— | —$CH_2CH_2$—O—$CH_2CH_2$— | —CO— | 2Cl |
| V-41 | —H | —H | —$SCH_3$ | —H | —H | —$CH_2$— | —$CH_2CH_2$—O—$CH_2CH_2$— | —CO— | 2Cl |
| V-42 | —H | —H | —$OCH_3$ | —H | —H | —$CH_2$— | —$CH_2CH_2$—O—$CH_2CH_2$— | —CO— | 2Cl |
| V-43 | —H | —H | —$COCH_3$ | —H | —H | —$CH_2$— | —$CH_2CH_2$—O—$CH_2CH_2$— | —CO— | 2Cl |
| V-44 | —H | —H | —$NO_2$ | —H | —H | —$CH_2$— | —$CH_2CH_2$—O—$CH_2CH_2$— | —CO— | 2Cl |
| V-45 | —H | —H | —Cl | —H | —H | —$CH_2$— | —$CH_2CH_2$—O—$CH_2CH_2$— | —NHCO— | 2Cl |
| V-46 | —H | —H | —H | —H | —H | —$CH_2$— | —$CH_2CH_2$—O—$CH_2CH_2$—O—$CH_2CH_2$— | —NHCO— | 2Cl |
| V-47 | —H | —H | —H | —H | —H | —$CH_2$— | —$CH_2CH_2$—O—$CH_2CH_2$—O—$CH_2CH_2$—O—$CH_2CH_2$— | —NHCO— | 2Cl |
| V-48 | —H | —H | —H | —H | —H | —$CH_2$— | —$CH_2CH_2CH_2$—O—$CH_2CH_2CH_2$— | —NHCO— | 2Cl |
| V-49 | —H | —H | —H | —H | —H | —$CH_2$— | —$CH_2CH_2CH_2$—O—$CH_2CH_2$—O—$CH_2CH_2CH_2$— | —NHCO— | 2Cl |
| V-50 | —H | —H | —H | —H | —H | —$CH_2$— | —$CH_2CH_2$—O—$CH_2CH_2$— | —$SO_2$— | 2Cl |
| V-51 | —H | —H | —H | —H | —H | —$CH_2$— | —$CH_2CH_2$—O—$CH_2CH_2$—O—$CH_2CH_2$— | —$SO_2$— | 2Cl |
| V-52 | —H | —H | —H | —H | —H | —$CH_2$— | —$CH_2CH_2$—O—$CH_2CH_2$—O—$CH_2CH_2$—O—$CH_2CH_2$— | —$SO_2$— | 2Cl |
| V-53 | —H | —H | —H | —H | —H | —$CH_2$— | —$CH_2CH_2CH_2$—O—$CH_2CH_2CH_2$— | —$SO_2$— | 2Cl |
| V-54 | —H | —H | —H | —H | —H | —$CH_2$— | —$CH_2CH_2CH_2$—O—$CH_2CH_2$—O—$CH_2CH_2CH_2$— | —$SO_2$— | 2Cl |
| V-55 | —H | —H | —H | —H | —H | —$CH_2$— | —$CH_2CH_2$—O—$CH_2CH_2$— | —NHCS— | 2Cl |

Ph = Phenyl group
Ts = Tosylate

In addition to the compounds above, Compounds (II-1) to (II-76) disclosed in JP-A-2001-92070 can be used.

The compounds represented by formulae (IV) and (V) can be synthesized from easily available amines. Synthesis examples of representative compounds are specifically shown below. Other compounds can also be synthesized in the same manner and this is described in Examples later.

Scheme 1

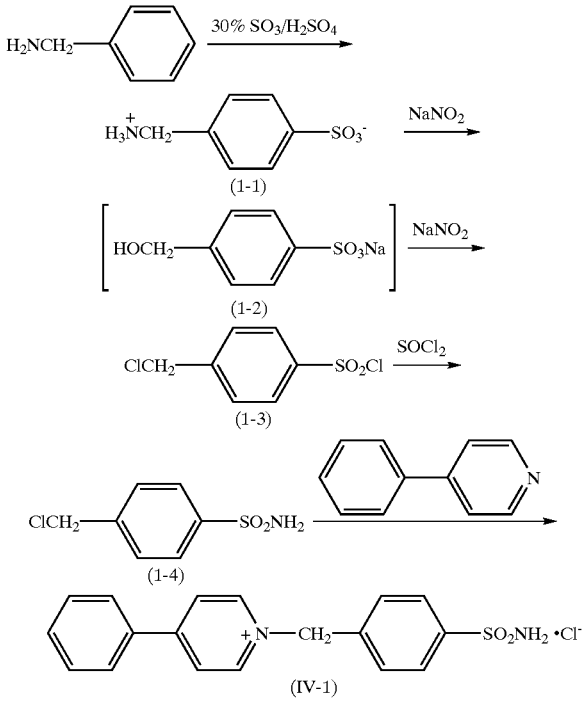

the crystal phase-controlling agents represented by formula (IV) and (V) have excellent face selectivity and the grain formed using these compounds can be more reduced in the thickness than the grain formed using a conventional crystal phase-controlling agent.

JP-A-10-104769 discloses a technique of preparing tabular grains more reduced in the thickness by using a (111) face crystal phase-controlling agent during the grain formation (formation of twin crystals). The (111) crystal phase-controlling agent of the present invention may be allowed to be present at any stage of the grain formation step but is preferably not allowed to be present at the nucleation and allowed to be present at the time of ripening and growth. To speak more specifically, the (111) crystal phase-controlling agent is preferably added after the completion of nucleation or at the time of ripening subsequent to the nucleation. The (111) crystal phase-controlling agent is preferably present also at the growth of tabular grains and the (111) crystal phase-controlling agent is preferably added, if desired, before the initiation of growth or during the growth. More preferably, the (111) crystal phase-controlling agent is continuously added at the growth of tabular grains.

In the silver halide light-sensitive material of the present invention, the crystal phase-controlling agents represented by formulae (I), (II), (III), (IV) and (V) can be used in combination of two or more thereof.

The crystal phase-controlling agents represented by formulae (I), (II), (III), (IV) and (V) each is preferably added in an amount of $5\times10^{-4}$ to 5 mol, more preferably from $5\times10^{-3}$ to $5\times10^{-1}$ mol, per mol of silver halide.

The gelatin for use in the present invention may be either an alkali-treated gelatin or an acid-treated gelatin but an alkali-treated gelatin is usually used in many cases. In particular, an alkali-treated gelatin subjected to a deionization treatment or an ultrafiltration treatment to remove impurity ion or impurities is preferably used. Other than the alkali-treated gelatin, examples of the gelatin which can be used include acid-treated gelatin, phthalated gelatin obtained Scheme 2

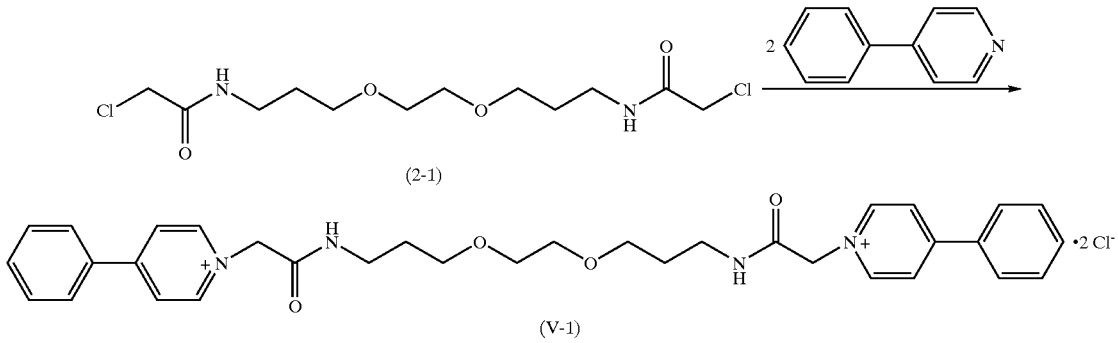

The compounds represented by formulae (I), (II), (III), (IV) and (V) are prominent in the property of selectively adsorbing to the (111) face of a silver halide crystal and these are called a (111) crystal phase-controlling agent. When this compound is allowed to be present during the formation of (111) main surface-type tabular grains, the compound selectively adsorbs to the main surface of a tabular grain to prevent the tabular grain to grow in the thickness direction, as a result, a thin tabular grain can be obtained. Particularly, by substituting the amino group of gelatin, succinated gelatin, trimellited gelatin, phenylcarbamyl gelatin, derivative gelatin (e.g., esterified gelatin obtained by substituting the carboxyl group of an aliphatic hydrocarbon having from 4 to 16 carbon atoms or gelatin), low molecular weight gelatin having a molecular weight of 1,000 to 80,000 (specific examples thereof include enzymolysate gelatin, acid and/or alkali hydrolysate gelatin and thermally decomposed gelatin), high molecular weight gelatin (molecular weight: 110, 000 to 300,000), gelatin having a methionine content of 50 μmol/g or less, gelatin having a tyrosine content of 30 μmol/g or less, oxidation-treated gelatin, and gelatin in which methionine is inactivated by alkylation. These gelatins may be used in combination of two or more thereof. The technique on the high molecular weight gelatin is disclosed in JP-A-11-237704. Also, gelatin having an antifoggant residue as a substituent described in JP-A-4-226449 and JP-A-3-37643 may be used. In the present invention, the amount of gelatin used in the process of forming grains is from 1 to 60 g/mol-Ag, preferably from 3 to 40 g/mol-Ag. In the present invention, the concentration of gelatin in the process of chemical sensitization is preferably from 1 to 100 g/mol-Ag, more preferably from 1 to 70 g/mol-Ag.

Gelatin is advantageously used as a protective colloid for use in the preparation of the emulsion of the present invention and as a binder for other hydrophilic colloid layers, however, other hydrophilic colloids can also be used.

Examples of other hydrophilic colloids which can be used include proteins such as gelatin derivative, graft polymer of gelatin to other polymer, albumin and casein; cellulose derivatives such as hydroxyethyl cellulose, carboxymethyl cellulose and cellulose sulfates; sugar derivatives such as sodium arginate and starch derivative; and various synthetic hydrophilic polymer materials such as homopolymer and copolymer of polyvinyl alcohol, polyvinyl alcohol partial acetal, poly-N-vinylpyrrolidone, polyacrylic acid, polymethacrylic acid, polyacrylamide, polyvinyl imidazole and polyvinyl pyrazole.

The gelatin may be a lime-processed gelatin, an enzyme-processed gelatin described in *Bull. Soc. Sci. Photo. Japan,* No. 16, p. 30 (1966), or a hydrolysate or enzymolysate of gelatin.

The emulsion of the present invention is preferably washed with water for desilvering to form a newly prepared protective colloid dispersion. The protective colloid used here can be the above-described hydrophilic colloid or gelatin. At this time, it is preferred to use gelatin containing 30% or more, preferably 35% or more, of a component having a molecular weight distribution of 280,000 or more. The water washing temperature may be selected according to the purpose but is preferably selected in the range from 5° C. to 50° C. The pH at the water washing can also be selected according to the purpose but is preferably selected in the range from 2 to 10, more preferably from 3 to 8. The pAg at the water washing can also be selected according to the purpose but is preferably selected in the range from 5 to 10. The water washing method may be selected from noodle water washing, dialysis using a diaphragm, centrifugal separation, coagulating precipitation and ion exchanging. In the case of coagulating precipitation, the method may be selected from a method of using a sulfate, a method of using an organic solvent, a method of using a water-soluble polymer and a method of using a gelatin derivative.

The molecular weight distribution of gelatin described in the present invention is determined by the high performance liquid chromatography. This method is described in detail in "*PAGI Ho" Shashin Yo Gelatin Shiken Ho* ("*PAGI Method", Photographic Gelatin Test Method*), 7th Ed., pp. 31–33 (1992), enacted by Shashin-Yo Gelatin Shiken-Ho Godo Shingi-Kai. The photographic gelatin is prepared by hydrolyzing biological collagen and the molecule thereof consists of a sub-α component having a molecular weight of less than 100,000, an α component having a molecular weight of near 100,000, an β component having a molecular weight of near 200,000, a γ component having a molecular weight of near 300,000 and a void component as a large molecular component having a molecular weight in excess of 300,000. The gelatin according to claims of the present invention is characterized by the presence of an alkali-treated ossein gelatin containing 30% or more in total of the γ component and the void component, namely, high molecular weight components having a molecular weight of 280,000 or more, based on the entire gelatin. The measurement example of general alkali-treated gelatin by the PAGI method is described in *Shashin Gakkai Shi* (*Journal of Photographic Society*), Vol. 58, No. 1, page 12, FIG. 6 (1995). In this publication, the void component is called Component H.

In the production of a silver halide emulsion according to the present invention, the additives which can be added from the grain formation until the coating are not particularly limited. Also, a combination with any known technique may be used. The techniques thereon are described in the following publications.

In order to promote the growth in the process of crystal formation or to effectively perform the chemical sensitization at the time of grain formation and/or chemical sensitization, a silver halide solvent may be used. The silver halide solvent which is often used is water-soluble thiocyanate, ammonia, thioether or thiourea. Examples of the silver halide solvent include thiocyanates (those described, for example, in U.S. Pat. Nos. 2,222,264, 2,448,534 and 3,320,069), ammonia, thioether compounds (those described, for example, in U.S. Pat. Nos. 3,271,157, 3,574,628, 3,704,130, 4,297,439 and 4,276,347), thione compounds (those described, for example, in JP-A-53-144319, JP-A-53-82408 and JP-A-55-77737), amine compounds (those described, for example, in JP-A-54-100717), thiourea derivatives (those described, for example, in JP-A-55-2982), imidazoles (those described, for example, in JP-A-54-100717) and substituted mercaptotetrazoles (those described, for example, in JP-A-57-202531).

The silver halide emulsion for use in the present invention may be produced using any conventionally known method. That is, an aqueous silver salt solution and an aqueous halogen salt solution are added to a reactor holding an aqueous gelatin solution while stirring efficiently. Specific examples of the preparation method include the methods described in P. Glafkides, *Chemie et Phisique Photographique,* Paul Montel (1967), G. F. Duffin, *Photographic Emulsion Chemistry,* The Focal Press (1966), and V. L. Zelikman et al., *Making and Coating Photographic Emulsion,* The Focal Press (1964). More specifically, any of an acidic process, a neutral process and an ammonia process may be used, and the form for reacting a soluble silver salt and a soluble halogen salt may be any of a single jet method, a double jet method and a combination thereof.

A so-called controlled double jet method of keeping constant the pAg of the liquid phase where silver halide is formed, which is one form of the double jet method, may also be used. The grains are preferably grown rapidly within the range of not exceeding the critical super-saturation degree, by using a method of changing the addition rate of silver nitrate or an aqueous alkali halide solution according to the grain growth speed described in British Patent 1,535,016, JP-B-48-36890 and JP-B-52-16364, or a method of changing the concentration of the aqueous solution described in U.S. Pat. No. 4,242,445 and JP-A-55-158124. These methods are preferred because renucleation does not occur and silver halide grains uniformly grow.

In place of adding a silver salt solution and a halogen salt solution to a reactor, a method of adding fine grains previously prepared to the reactor to cause nucleation and/or grain growth and thereby obtain silver halide grains is preferred and the technique thereon is described in JP-A-1-183644, JP-A-1-183645, U.S. Pat. No. 4,879,208, JP-A-2-44335, JP-A-2-43534 and JP-A-2-43535. According to this method, the halide ion distribution within the emulsion grain crystal can be made completely uniform and preferred photographic properties can be obtained.

Furthermore, emulsion grains having various structures can be used in the present invention. A so-called core-shell double structure grain consisting of a grain inside (core) and a grain outside (shell), a triple structure grain disclosed in JP-A-60-222844, or a greater multilayer structure grain may be used. When an emulsion grain is intended to have a structure in the inside thereof, not only a grain having the above-described wrapping structure but also a grain having a so-called junction structure may be prepared. Examples thereof are disclosed in JP-A-59-133540, JP-A-58-108526, EP-A-199290, JP-B-58-24772 and JP-A-59-16254. The crystal joined may have a composition different from the host crystal and can be grown to join to the edge or corner part or on the plane part of a host crystal. Whichever the halogen composition of the host crystal has a uniform structure or a core-shell structure, the junction crystal can be formed. In the case of the junction structure, silver halide and silver halide can of course be combined but if a combination and junction structure with silver halide can be formed, a silver salt compound not having a rock-salt structure, such as silver rhodanide and silver carbonate, may also be used.

In the case of a silver iodobromide grain having the above-described structure, for example, in a core-shell type grain, the silver iodide content may be high in the core part and low in the shell part or on the contrary, the silver iodide content may be low in the core part and high in the shell part. Similarly, in the case of a grain having a junction structure, the grain may comprise a host crystal having a high silver iodide content and a junction crystal having a relatively low silver iodide content or the grain may have a reverse relationship of silver iodide content. The boundary part between the portions different in the halogen composition of a grain having the above-described structure may be clear or may be unclear by forming a mixed crystal using difference in the composition or furthermore, a continuous structure change may be positively provided.

The silver halide emulsion for use in the present invention may be subjected to a treatment of rounding the grains disclosed in EP-B-0096727 and EP-B-0064412 or to a surface modification disclosed in DE-C-2306447 and JP-A-60-221320.

In the present invention, chemical sensitization may be performed using chalcogen sensitization (for example, sulfur sensitization, selenium sensitization and tellurium sensitization), noble metal sensitization and reduction sensitization individually or in combination.

When a compound represented by formula (I) of JP-A-2001-42466 is added, the obtained silver halide light-sensitive material can have higher sensitivity. The compound represented by formula (I) of JP-A-2001-42466 may be used in any stage during the preparation of emulsion or during the production of light-sensitive material (for example, at the grain formation, in the process of desalting, at the chemical sensitization or before the coating).

The compound represented by formula (I) of JP-A-2001-42466 is preferably used in an emulsion layer but may be added not only to an emulsion layer but also to a protective layer or an interlayer and allowed to diffuse at the coating.

The compound represented by formula (I) of JP-A-2001-42466 is contained in a silver halide emulsion layer at a ratio of $1\times10^{-9}$ to $5\times10^{-2}$ mol, preferably from $1\times10^{-8}$ to $2\times10^{-3}$ mol, per mol of silver halide.

In the sulfur sensitization, a labile sulfur compound is used and examples of the labile sulfur compound which can be used include those described in P. Glafkides, *Chemie et Physique Photographique,* 5th ed., Paul Montel (1987), and *Research Disclosure,* Vol. 307, No. 307105. Specific examples thereof include known sulfur compounds such as thiosulfates (e.g., hypo), thioureas (e.g., diphenylthiourea, triethylthiourea, N-ethyl-N'-(4-methyl-2-thiazolyl)-thiourea, carboxymethyltrimethylthiourea), thioamides (e.g., thioacetamide), rhodanines (e.g., diethylrhodanine, 5-benzylidene-N-ethyl-rhodanine), phosphinesulfides (e.g., trimethylphosphinesulfide), thiohydantoins, 4-oxo-oxazolidine-2-thiones, dipolysulfides (e.g., dimorpholine-disulfide, cystine, hexathiocane-thione), mercapto compounds (e.g., cysteine), polythionates and elemental sulfur. Active gelatin may also be used.

In the selenium sensitization, a labile selenium compound is used and examples of the labile selenium compound which can be used include those described in JP-B-43-13489, JP-B-44-15748, JP-A-4-25832, JP-A-4-109240, JP-A-4-271341 and Japanese Patent Application No. 3-82929. Specific examples thereof include colloidal metal selenium, selenoureas (e.g., N,N-dimethylselenourea, trifluoromethyl-carbonyltrimethylselenourea, acetyl-trimethylselenourea), selenoamides (e.g., selenoamide, N,N-diethylphenyl-selenoamide), phosphine selenides (e.g., triphenylphosphineselenide, pentafluorophenyl-triphenylphosphineselenide), selenophosphates (e.g., tri-p-tolylselenophosphate, tri-n-butylselenophosphate), selenoketones (e.g., selenobenzophenone), isocyanates, selenocarboxylic acids, selenoesters and diacyl selenides. In addition, relatively stable selenium compounds such as selenious acid, potassium selenocyanate, selenazoles and selenides described in JP-B-46-4553 and JP-B-52-34492 may also be used.

In the tellurium sensitization, a labile tellurium compound is used and examples of the labile tellurium compound which can be used include those described in Canadian Patent 800,958, British Patents 1,295,462 and 1,396,696, JP-A-4-204640, JP-A-4-271341, JP-A-4-333043 and JP-A-5-303157. Specific examples thereof include telluroureas (e.g., tetramethyltellurourea, N,N'-dimethylethylenetellurourea, N,N'-diphenylethylenetellurourea), phosphinetellurides (e.g., butyldiisopropylphosphine telluride, tributylphosphine telluride, tributoxyphosphine telluride, ethoxydiphenylphophine telluride), diacyl (di)tellurides (e.g., bis(diphenylcarbamoyl) ditelluride, bis(N-phenyl-N-methylcarbamoyl) ditelluride, bis(N-phenyl-N-methylcarbamoyl) telluride, bis(ethoxycarbonyl) telluride), isotellurocyanates, telluroamides, tellurohydrazides, telluroesters (e.g., butylhexyltelluroester), telluroketones (e.g., telluroacetophenone), colloidal tellurium, (di)tellurides and other tellurium compounds (e.g., potassium telluride, sodium telluropentathionate).

In the noble metal sensitization, a salt of noble metals such as gold, platinum, palladium and iridium may be used and examples thereof include those described in P. Glafkides, *Chemie et Phisigue Photographigue,* 5th ed., Paul Montel (1987) and *Research Disclosure,* Vol. 307, No. 307105. In particular, gold sensitization is preferred. Specific examples of the gold salt which can be used include potassium chloroaurate, potassium aurithiocyanate, gold sulfide, gold selenide, bis(1,4,5-trimethyl-1,2,4-triazolium-3-thiolate) gold(1) tetrafluoroborate described in U.S. Pat. No. 5,049,485, and gold compounds described in U.S. Pat. Nos. 2,642,361, 5,049,484 and 5,049,485.

In the reduction sensitization, a known reducing compound may be used and examples thereof include those described in P. Glafkides, *Chemie et Phisigue Photographigue,* 5th ed., Paul Montel, (1987), and *Research Disclosure,* Vol. 307, No. 307105. Specific examples thereof include aminoiminomethanesulfinic acid (also called thiourea dioxide), borane compounds (e.g., dimethylaminoborane), hydrazine compounds (e.g., hydrazine, p-tolylhydrazine), polyamine compounds (e.g., diethylenetriamine, triethylenetetramine), stannous chloride, silane compounds, reductones (e.g., ascorbic acid), sulfites, aldehyde compounds and hydrogen gas. The reduction sensitization may also be performed in an atmosphere of high pH or excess silver ion (so-called silver ripening).

These chemical sensitization treatments may be used individually or in combination of two or more thereof and when used in combination, a combination of chalcogen sensitization and gold sensitization is preferred. The reduction sensitization is preferably performed at the formation of silver halide grains.

The chalcogen sensitizer for use in the present invention is used in an amount of $10^{-8}$ to $10^{-2}$ mol, preferably on the order of $10^{-7}$ to $5\times10^{-3}$ mol, per mol of silver halide, though the amount used varies depending on the silver halide grain used and the chemical sensitization conditions.

The noble metal sensitizer for use in the present invention is used in an amount on the order of $10^{-7}$ to $10^{-2}$ mol per mol of silver halide. In the present invention, the conditions for chemical sensitization are not particularly limited, however, the pAg is from 6 to 11, preferably from 7 to 10, the pH is preferably from 4 to 10, and the temperature is preferably from 40 to 95° C., more preferably from 45 to 85° C.

EXAMPLE

The present invention is described in greater detail below by referring to Examples, however, the present invention should not be construed as being limited thereto.

In Examples, the following crystal phase-controlling agents were used.

Crystal Phase-Controlling Agent I

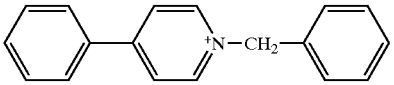

Crystal Phase-Controlling Agent II

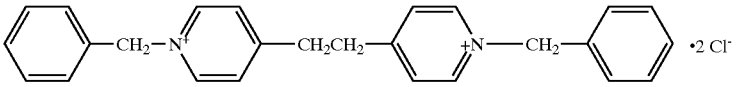

Crystal Phase-Controlling Agent IV-1

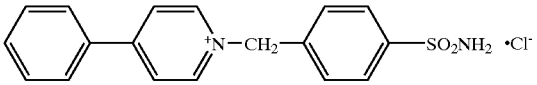

Crystal Phase-Contolling Agent V-1

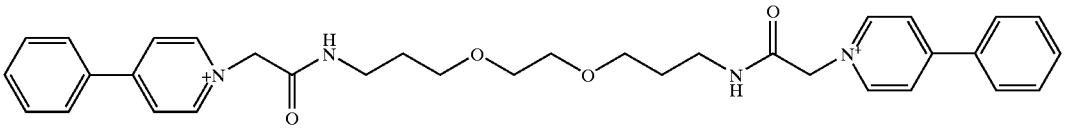

Crystal Phase-Controlling Agent V-2

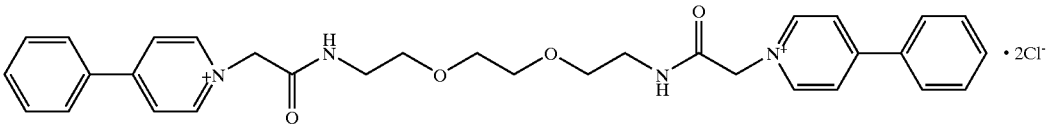

Synthesis Example 1

Synthesis of Compound (IV-1)

Synthesis of (Intermediate 1-1)

Into a three-neck flask, 100 mL (1.8 mol) of sulfuric acid was charged and while thoroughly stirring, the solution was cooled in an ice-methanol bath. While keeping the inner temperature at 35 to 45° C., 107.2 g (1 mol) of benzylamine was added dropwise. After the dropwise addition, the cooling bath was removed and then 267.0 g (1 mol) of 30% fuming sulfuric acid was added dropwise under ice cooling. At this time, the inner temperature was elevated to about 60° C. After the dropwise addition, the resulting solution was stirred at 60° C. for 30 minutes and the reaction solution was added dropwise to 500 g of ice. The precipitated crystals were collected by filtration under reduced pressure and washed by splashing with 50 ml of saturated brine and then with 100 mL of methanol to obtain 84.1 g (yield: 45.0%) of Compound (1-1).

Synthesis of (Intermediate 1-3)

Into a three-neck flask, 37.4 g (0.2 mol) of Compound (1-1) and 1 L of 0.04M sodium acetate were charged and while thoroughly stirring, acetic acid was added to adjust the pH to 3.3. Then, the outer temperature was set to 40° C. and 13.8 g (0.2 mol) of sodium nitrite dissolved in 60 mL of water was added dropwise, After the dropwise addition, the solution was reacted for 2 hours (outer temperature: 40° C.) to give a homogeneous reaction system. The reaction solvent was distilled out under reduced pressure, 300 mL of toluene was added, and the resulting solution was distilled out under reduced pressure to completely remove the water to obtain crude Compound (1-2). Thereto, 200 mL of toluene was added and while thoroughly stirring, 51 mL (0.7 mol) of thionyl chloride and 1 mL of DMF were added. The resulting solution was reacted at 70° C. for 1 hour and then toluene and residual thionyl chloride were distilled out under reduced pressure. Thereafter, ethyl acetate was added, insoluble inorganic salts were removed by filtration under reduced pressure and ethyl acetate was distilled off under reduced pressure to obtain 28.0 g (yield: 62.2%) of Compound (1-3).

Synthesis of (Intermediate 1-4)

Into a three-neck flask, 33.8 g (0.15 mol) of Compound (1-3) and 225 mL of acetonitrile were added and while thoroughly stirring, the solution was cooled in an ice-methanol bath. While keeping the inner temperature at 15 to 20° C., ammonia gas was blown thereinto. After confirming no absorption of the gas, 225 mL of water was added. The precipitated crystals were collected by filtration under reduced pressure and washed by splashing with 200 mL of water to obtain 28.4 g (yield: 91.8%) of Compound (1-4).

Synthesis of Compound (IV-1)

Into a three-neck flask, 20.5 g (0.1 mol) of Compound (1-4), 15.5 g (0.1 mol) of 4-phenylpyridine and 45 mL of isopropyl alcohol were charged and refluxed under heating for 3 hours while thoroughly stirring (precipitation of crystals). Thereto, 150 mL of acetonitrile was added and the crystals were collected by filtration under reduced pressure to obtain crude Compound (IV-1).

The obtained crude Compound (IV-1) was charged into a Kjeldahl flask and thereto 300 mL of methanol was added and dissolved under heating. After removing dusts by filtration, 300 mL of isopropyl alcohol was slowly added while thoroughly stirring. The precipitated crystals were collected by filtration under reduced pressure and then washed by splashing with 50 mL of acetonitrile to obtain 32.3 g (yield: 89.6%) Crystal Phase-Controlling Agent (IV-1). The structure was confirmed by NMR. $^1$H NMR (300 MHz DMSO-d6) δ6.0 (2H, s), 7.5 (2H, s), 7.7 (3H, m), 7.9 (4H, dd), 8.1 (2H, d), 9.0 (4H, dd).

Synthesis Example 2

Synthesis of Compound (V-1)

Synthesis of (Intermediate 2-1)

Into a three-neck flask, 17.6 (0.1 mol) of ethylene glycol bis(3-aminopropyl) ether and 150 ml of acetonitrile were charged and while thoroughly stirring, 24.3 g (0.24 mol) of triethylamine was added. The resulting solution was cooled in an ice-methanol bath. and while keeping the inner temperature at 5° C. or less, 24.8 g (0.22 mol) of chloroacetyl chloride was added dropwise. After the dropwise addition, the solution was reacted at room temperature for 1 hour and the acetonitrile was distilled off under reduced pressure. Thereto, 300 mL of diluted aqueous hydrochloric acid and 500 mL of ethyl acetate were added and the resulting solution was vigorously shaken. After leaving the solution to stand for 10 minutes, the aqueous phase was removed. After adding 300 mL of aqueous sodium bicarbonate, the same operation was performed and the ethyl acetate phase was dried over magnesium sulfate. The desiccating agent was removed by filtration and the ethyl acetate was distilled off under reduced pressure to obtain 27.0 g (yield: 82.0%) of Compound (2-1).

Synthesis of Compound (V-1)

Into a three-neck flask, 26.3 g (0.08 mol) of Compound (2-1), 24.8 g (0.16 mol) of 4-phenylpyridine and 150 mL of isopropyl alcohol were charged and while thoroughly stirring, the solution was refluxed under heating for 2 hours. Then, 200 mL of methanol was added, the temperature returned to room temperature, 1 g of activated carbon was added and the resulting solution was stirred for 20 minutes. The reaction system was filtered through Celite and the solvent was distilled off under reduced pressure to obtain crude Compound (V-1) (oily).

To the obtained crude Compound (V-1), 80 mL of methanol was added and the solution was refluxed under heating. While continuing the ref luxing, 800 mL of ethyl acetate was slowly added. The system was returned to room temperature and methyl-ethyl acetate was removed by decantation. This purification operation was performed more two times to obtain 38.8 g (oily, yield: 76.0%) of Crystal Phase-Controlling Agent (V-1). The structure was confirmed by NMR. $^1$H NMR (300 MHz DMSO-d6) 1.7 (4H, t), 3.7 (6H, m), 3.5 (6H, m), 5.6 (4H, s), 7.6 (6H, m), 8.4 (8H, dd), 9.1 (4H, d), 9.2 (2H, t).

Example 1

Pure Silver Bromide Tabular Grain Emulsion

Emulsion 1-A (Invention)

In a system shown in FIG. 2 of JP-A-10-239787, tabular grains were prepared as follows using a mixing vessel (inner volume of mixing vessel: 0.5 mL) shown in FIG. 1 of JP-A-10-239787. In this Example, a method of performing both the nucleation and the grain growth using a mixing vessel is described.

In a mixing vessel, 250 mL of an aqueous 0.0029M silver nitrate solution and 250 mL of an aqueous 0.0089M KBr solution containing 0.1% by mass (i.e., by weight) of low molecular weight gelatin (average molecular weight: 40,000) were continuously added each at a constant flow rate over 10 minutes. The obtained emulsion was consecutively received in a reactor over 10 minutes to obtain 500 mL of a nucleus emulsion. At this time, the stirring and rotation number of the mixing vessel was 2,000 rpm. (Nucleation)

After the completion of nucleation, while thoroughly stirring the nucleus emulsion within the reactor, 11 mL of a 0.8M KBr solution and 200 mL of 10% by mass trimellitic gelatin containing 0.1 mmol of Crystal Phase-Controlling Agent IV-1 were added and after elevating the temperature to 75° C., the emulsion was left standing for 30 minutes. (Ripening)

To the emulsion after ripening, 300 mL of a 10% by mass solution of lime-treated gelatin crosslinked by a vinylsulfone-base crosslinking agent [H-6] described in JP-A-11-237704, where the sum of void and γ moieties occupies 40% in the entire gelatin in the molecular weight distribution measured by the PAGI method, was added and dissolved. Then, 60 mL of 1/50M Crystal Phase-Controlling Agent I was added.

Thereafter, 1,000 mL of an aqueous 0.6M silver nitrate solution and 1,000 mL of an aqueous 0.6M KBr solution containing 90 g of a low molecular weight lime-processed ossein gelatin (average molecular weight: 40,000) were again added to the mixing vessel each at a constant flow rate over 92 minutes. The fine grain emulsion produced in the mixing vessel was consecutively added to the reactor. At this time, the stirring and rotation number of the mixing vessel was 2,000 rpm. At the same time, 90 mL of a solution of 1/50M Crystal Phase-Controlling Agent IV-1 and 92 mL of a 1.45M KBr solution were continuously added to the reactor each at a constant flow rate over 92 minutes. The stirring blade in the reactor was rotated at 800 rpm and the emulsion was thoroughly stirred. (Growth)

During the growth of grains, $8\times10^{-8}$ mol/mol-Ag of $IrCl_6$ was added and doped when 70% of silver nitrate was added. Before the completion of grain growth, a solution of yellow prussiate of potash was added to the mixing vessel. The yellow prussiate of potash was doped to give a local concentration of $3\times10^{-4}$ mol/mol-Ag in 3% (in terms of silver added) of the shell part. After the completion of addition, the emulsion was cooled to 35° C. and washed by ordinary flocculation and thereto, 70 g of lime-processed ossein gelatin was added and dissolved to adjust the pAg and the pH to 8.7 and 6.5, respectively. Thereafter, the emulsion was stored in a cool and dark place. The characteristics of the obtained tabular grains are shown in Table 1.

Emulsion 1-B (Comparison)

Emulsion 1-B was prepared in the same manner as Emulsion 1-A except that in the nucleation of Emulsion 1-A, 0.1 mmol of Crystal Phase-Controlling Agent I was incorporated into 250 mL of an aqueous 0.0089M KBr solution containing 0.1% by mass of a low molecular weight gelatin (average molecular weight: 40,000) and the addition of 0.1 mocl of Crystal Phase-Controlling Agent IV-1 after the nucleation was omitted. The characteristics of the obtained tabular grains are shown in Table 1.

Emulsion 1-C (Comparison)

Emulsion 1-C was prepared in the same manner as Emulsion 1-A except that in Emulsion 1-A, an alkali-processed ossein gelatin where the sum of void and γ moieties occupies 20% in the entire gelatin was added after the ripening in place of the crosslinked lime-processed gelatin where the sum of the void and γ moieties occupies 40% in the entire gelatin.

Emulsion 1-D (Comparison)

Emulsion 1-D was prepared in the same manner as Emulsion 1-A except that 92 mL of a 0.48M KBr solution was continuously added in place of 92 mL of a 1.45M KBr solution which was continuously added to the reactor at a constant flow rate over 92 minutes during the growth in Emulsion 1-A. The characteristics of the obtained tabular grains are shown in Table 1.

Emulsion 1-E (Comparison)

Emulsion 1-E was prepared in the same manner as Emulsion 1-A except that the additions of 60 mL and 90 mL of a solution of 1/50M Crystal Phase-Controlling Agent I added before and during the growth of Emulsion 1-A were omitted.

The characteristics of the obtained tabular grains are shown in Table 1.

TABLE 1

| Emulsion | Average Equivalent-Circle Diameter (μm) | Average Thickness (μm) | Average Particle Ratio (projected area) | Remaining of Fine Particle (%) |
|---|---|---|---|---|
| 1-A (Invention) | 6.1 | 0.030 | 93% | none |
| 1-B (Comparison) | 2.0 | 0.040 | 65% | none |
| 1-C (Comparison) | 2.8 | 0.080 | 90% | none |
| 1-D (Comparison) | 3.1 | 0.030 | 92% | 10% |
| 1-E (Comparison) | 2.7 | 0.055 | 92% | none |

*Amount of silver in residual fine grains/total amount of silver used × 100

In Table 1, the equivalent-circle diameter means a diameter of a circle when the projected area of a tabular grains is converted into a circle, and the tabular grain ratio means a ratio of the projected area of tabular grains having an aspect ratio of 5 or more to the total projected area. The tabular grain of the present invention has a very small thickness and a very large equivalent-circle diameter. In Emulsion 1-B, cubic grains are mingled and therefore, the tabular grain ratio is lowered. These emulsions each was subjected to optimal chemical sensitization and optimal spectral sensitization, and the photographic performance was compared. As a result, Emulsion 1-A was verified to have remarkably high sensitivity.

Example 2

Silver Iodobromide Tabular Grain Emulsion

Emulsion 2-A (Invention)

In the mixing vessel used in Example 1, 250 mL of an aqueous 0.0029M silver nitrate solution and 250 mL of an aqueous 0.0089M KBr solution containing 0.1% by mass (i.e., by weight) of low molecular weight gelatin (average molecular weight: 40,000) were continuously added each at a constant flow rate over 10 minutes. The obtained emulsion was consecutively received in a reactor over 10 minutes to obtain 500 mL of a nucleus emulsion. At this time, the stirring and rotation number of the mixing vessel was 2,000 rpm. (Nucleation)

After the completion of nucleation, while thoroughly stirring the nucleus emulsion within the reactor, 11 mL of a 0.8M KBr solution and 200 mL of 10% by mass trimellited gelatin containing 0.1 mmol of Crystal Phase-Controlling Agent IV-1 were added and after elevating the temperature to 75° C., the emulsion was left standing for 30 minutes. (Ripening)

To the emulsion after ripening, 300 mL of a 10% by mass solution of lime-treated gelatin crosslinked by a vinylsulfone-base crosslinking agent [H-6] described in JP-A-11-237704, where the sum of void and γ moieties occupies 40% in the entire gelatin in the molecular weight distribution measured by the PAGI method, was added and dissolved. Then, 60 mL of 0.04M $Al(NO_3)_3.9H_2O$ solution was added thereto and after 2 minutes, 60 mL of 1/50M Crystal Phase-Controlling Agent I was added.

Thereafter, 1,000 mL of an aqueous 0.6M silver nitrate solution and 1,000 mL of an aqueous 0.59M KBr solution containing 90 g of a low molecular weight methyl-esterified gelatin (average molecular weight: 40,000) and 3 mol % of KI were again added to the mixing vessel each at a constant flow rate over 92 minutes. The fine grain emulsion produced in the mixing vessel was consecutively added to the reactor. At this time, the stirring and rotation number of the mixing vessel was 2,000 rpm. At the same time, 90 mL of a solution of 1/50M Crystal Phase-Controlling Agent IV-1 and 92 mL of a 1.45M KBr solution were continuously added to the reactor each at a constant flow rate over 92 minutes. The stirring blade in the reactor was rotated at 800 rpm and the emulsion was thoroughly stirred. (Growth)

During the growth of grains, $8\times10^{-8}$ mol/mol-Ag of $IrCl_6$ was added and doped when 70% of silver nitrate was added. Before the completion of grain growth, a solution of yellow prussiate of potash was added to the mixing vessel. The yellow prussiate of potash was doped to give a local concentration of $3\times10^{-4}$ mol/mol-Ag in 3% (in terms of silver added) of the shell part. After the completion of addition, the emulsion was cooled to 35° C. and washed by ordinary flocculation and thereto, 70 g of lime-processed ossein gelatin was added and dissolved to adjust the pAg and the pH to 8.7 and 6.5, respectively. Thereafter, the emulsion was stored in a cool and dark place. The characteristics of the obtained tabular grains are shown in Table 1.

Emulsion 2-B (Comparison)

Emulsion 2-B was prepared in the same manner as Emulsion 2-A except that an alkali-processed ossein gelatin where the sum of void and γ moieties occupies 20% in the entire gelatin was added in place of the lime-processed gelatin crosslinked by a vinylsulfone-base crosslinking agent [H-6] where the sum of the void and γ moieties occupies 40% in the entire gelatin, which was added before entering the growth step of Emulsion 2-A. The characteristics of the obtained tabular grains are shown in Table 2.

Emulsion 2-C (Comparison)

Emulsion 2-C was prepared in the same manner as Emulsion 2-A except that the addition of 0.1 mmol of Crystal Phase-Controlling Agent IV-1 used in the ripening of Emulsion 2-A and the additions of 60 mL and 90 mL of a solution of 1/50M Crystal Phase-Controlling Agent I added before and during the growth of Emulsion 1-A were omitted.

The characteristics of the obtained tabular grains are shown in Table 2.

Emulsion 2-D (Invention)

Emulsion 2-D was prepared in the same manner as in Emulsion 2-A except that a low molecular weight lime-processed ossein gelatin (average molecular weight: 40,000) was used in place of the low molecular weight methyl-esterified gelatin added as a protective colloid for forming fine grains in a mixing vessel during the growth step of Emulsion 2-A.

Example 3

Silver Iodobromide Tabular Grain Emulsion (Comparison)

Emulsion 3-A

In a reactor under thorough stirring, 1.0 liter of water, 3 g of low molecular weight ossein gelatin (average molecular weight: 20,000) and 0.5 g of KBr were added and dissolved. To the resulting solution which was kept at 45° C., 5 mL of a 0.5M silver nitrate solution and 10 mL of a 0.3M KBr solution were added over 20 seconds while thoroughly stirring. (Nucleation)

To the emulsion, 22 mL of a 0.8M KBr solution and 300 mL of a 10% trimellited gelatin solution containing 0.1 mmol of Crystal Phase-Controlling Agent IV-1 were added and after elevating the temperature to 75° C. over 30 minutes, the emulsion was ripened at 75° C. for 5 minutes. (Ripening)

Thereafter, to the reactor under thorough stirring, 1,000 mL of an aqueous 0.6M silver nitrate solution, 1,000 mL of an aqueous 0.6M KBr solution containing 3 mol % of KI, and 150 mL of a solution of 1/50M Crystal Phase-Controlling Agent IV-1 were continuously added by a double jet method each at a constant flow rate over 58 minutes. The stirring blade in the reactor was rotated at 800 rpm. (Growth)

After the completion of addition, the emulsion was cooled to 35° C. and washed by ordinary flocculation and thereto, 70 g of lime-processed ossein gelatin was added and dissolved to adjust the pAg and the pH to 8.7 and 6.5, respectively. Thereafter, the emulsion was stored in a cool and dark place.

Example 4

Silver Iodobromide Tabular Grain Emulsion (Comparison)

Emulsion 4-A

In a reactor under thorough stirring, 1.0 liter of water, 3 g of low molecular weight ossein gelatin (average molecular weight: 20,000) and 0.5 g of KBr were added and dissolved. To the resulting solution which was kept at 45° C., 5 mL of a 0.5M silver nitrate solution and 10 mL of a 0.3M KBr solution were added over 20 seconds while stirring. (Nucleation)

To the emulsion, 22 mL of a 0.8M KBr solution and 300 mL of a 10% trimellited gelatin solution containing 0.2 mmol of Crystal Phase-Controlling Agent IV-1 were added and after elevating the temperature to 75° C. over 30 minutes, the emulsion was ripened at 75° C. for 5 minutes. (Ripening)

Thereafter, to the reactor under thorough stirring, 200 mL of an aqueous 2.52M KBr solution was added and then 1,000 mL of an aqueous 0.6M silver nitrate solution and 1,000 mL of an aqueous 0.6M KBr solution containing 3 mol % of KI were continuously added by a double jet method over 58 minutes. The stirring blade in the reactor was rotated at 800 rpm. (Growth)

After the completion of addition, the emulsion was cooled to 35° C. and washed by ordinary flocculation and thereto, 70 g of lime-processed ossein gelatin was added and dissolved to adjust the pAg and the pH to 8.7 and 6.5, respectively. Thereafter, the emulsion was stored in a cool and dark place.

Example 5

Large-Size Tabular Grain Emulsion (Invention)

Emulsion 5-A

Emulsion 5-A was prepared in the same manner as Emulsion 1-A except that in the preparation of Emulsion 1-A of Example 1, 60 mL of a 0.04M $Al(NO_3)_3.9H_2O$ solution was added after the ripening at the same time with the addition of the crosslinked gelatin and 90 g of a low molecular weight methyl-esterified gelatin (average molecular weight: 40,000) was added in place of 90 g of the low molecular weight lime-processed ossein gelatin added to the mixing vessel in the growth step. The characteristics of the obtained tabular grains are shown in Table 2.

TABLE 2

| Emulsion | Average Equivalent-Circle Diameter (μm) | Average Thickness (μm) | Average Particle Ratio (projected area) | Remaining of Fine Particle (%) |
|---|---|---|---|---|
| 2-A (Invention) | 7.5 | 0.030 | 94% | none |
| 2-B (Comparison) | 3.5 | 0.069 | 75% | 2% |
| 2-C (Comparison) | 3.2 | 0.075 | 95% | none |
| 2-D (Invention) | 6.1 | 0.035 | 94% | 5% |
| 3-A (Comparison) | 4.5 | 0.090 | 92% | none |
| 4-A (Comparison) | 4.3 | 0.110 | 93% | none |
| 5-A (Invention) | 17.5 | 0.036 | 93% | none |

*Amount of silver in residual fine grains/total amount of silver used × 100

Example 6

Emulsion 1-A of Example 1 and Emulsion 2-A of Example 2 each was subjected to optimal chemical sensitization and optimal spectral sensitization and used as the emulsion for the third layer of Sample 201 in Example 2 of JP-A-9-146237. The obtained light-sensitive material was processed in the same manner as in Example 2 of JP-A-9-146237, then, good results were obtained. Furthermore, Emulsion 1-A and Emulsion 2-A each was subjected to optimal chemical sensitization and optimal spectral sensitization and used as the emulsion for the third layer of Sample 110 in Example 2 of JP-A-10-20462. The obtained light-sensitive material was processed in the same manner as in Example 2 of JP-A-10-20462, then, good results were obtained.

Example 7

The face selectivity of the crystal phase-controlling agent was evaluated by measuring the heat of adsorption as follows.

The calorimeter used was Multipurpose Calorimeter Model MPC-II manufactured by Tokyo Rico. Into the inner cell for calorimeter measurement, 4.5 g of a silver bromide cubic or octahedral emulsion having an equivalent-circle diameter of 0.5 μm and adjusted to a pH of 6.5 was charged together with 1.5 mL of Kolthoff's buffer solution with a pH of 6.5. Into the outer cell side, 5 mL of a solution obtained by dissolving a crystal phase-controlling agent corresponding to 30% of the saturated adsorption amount in Kolthoff's buffer solution with a pH of 6.5 was charged. After mounting the cells to the calorimeter at 40° C. for 3 hours, the inner cell was vibrated and the quantity of heat generated was measured.

The characteristics of the obtained crystal phase-controlling agents are shown in Table 3.

TABLE 3

| Crystal Phase-Controlling Agent | Heat of Adsorption of Octahedral ((111) face) (kcal/mol) | Heat of Adsorption of Cubic ((100) face) (kcal/mol) | Octa-hedral-Cubic (kcal/mol) |
|---|---|---|---|
| Crystal Phase-Controlling Agent I (Comparison) | 11.5 | 8.3 | 3.2 |
| Crystal Phase-Controlling Agent II (Comparison) | 16.5 | 11.6 | 4.9 |
| Crystal Phase-Controlling Agent IV-1 (Invention) | 12.5 | 5.8 | 6.7 |
| Crystal Phase-Controlling Agent V-1 (Invention) | 9.6 | 3.5 | 6.1 |
| Crystal Phase-Controlling Agent V-2 (Invention) | 16.8 | 6.1 | 10.7 |

As seen from Table 3, in Crystal Phase-Controlling Agents IV-1, V-1 and V-2 of the present invention, the difference in the heat of adsorption between octahedral (111 face) and cubic (100 face) is large and the (111) face adsorption selectivity is high, as compared with Crystal Phase-Controlling Agents I and II for Comparison.

Example 8

Pure Silver Bromide Tabular Grain Emulsion

Emulsion 8-A (Comparison)

In a system shown in FIG. 2 of JP-A-10-239787, tabular grains were prepared as follows using a mixing vessel (inner volume of mixing vessel: 0.5 mL) shown in FIG. 1 of JP-A-10-239787. In this Example, a method of performing both the nucleation and the grain growth using a mixing vessel is described.

In a mixing vessel, 250 mL of an aqueous 0.0029M silver nitrate solution and 250 mL of an aqueous 0.0089M KBr solution containing 0.1% by mass of low molecular weight gelatin (average molecular weight: 40,000) were continuously added over 10 minutes and the obtained product was received into the reaction vessel to obtain 500 mL of a nucleus emulsion. At this time, the stirring and rotation number of the mixing vessel was 2,000 rpm. (Nucleation)

After the completion of nucleation, while thoroughly stirring the nucleus emulsion within the reactor, 11 mL of a 0.8M KBr solution and 200 mL of 10% by mass (i.e., by weight) trimellited gelatin containing 0.1 mmol of Crystal Phase-Controlling Agent I were added and after elevating the temperature to 75° C., the emulsion was left standing for 30 minutes. (Ripening)

To the emulsion after ripening, 300 mL of a 10% by mass solution of lime-treated gelatin crosslinked by a vinylsulfone-base crosslinking agent [H-6] described in JP-A-11-237704, where the sum of void and γ moieties occupies 40% in the entire gelatin in the molecular weight distribution measured by the PAGI method, was added and dissolved. Then, 60 mL of 1/50M Crystal Phase-Controlling Agent I was added.

Thereafter, 1,000 mL of an aqueous 0.6M silver nitrate solution and 1,000 mL of an aqueous 0.6M KBr solution containing 90 g of a low molecular weight lime-processed gelatin (average molecular weight: 40,000) were again added to the mixing vessel each in a constant amount over 92 minutes. The fine grain emulsion produced in the mixing vessel was consecutively added to the reactor. At this time, the stirring and rotation number of the mixing vessel was 2,000 rpm. At the same time, 90 mL of a solution of 1/50M Crystal Phase-Controlling Agent I and 92 mL of a 1.45M KBr solution were continuously added to the reactor each at a constant flow rate over 92 minutes. The stirring blade in the reactor was rotated at 800 rpm and the emulsion was thoroughly stirred. (Growth)

During the growth of grains, $8\times10^{-8}$ mol/mol-Ag of $IrCl_6$ was added and doped when 70% of silver nitrate was added. Before the completion of grain growth, a solution of yellow prussiate of potash was added to the mixing vessel. The yellow prussiate of potash was doped to give a local concentration of $3\times10^{-4}$ mol/mol-Ag in 3% (in terms of silver added) of the shell part. After the completion of addition, the emulsion was cooled to 35° C. and washed by ordinary flocculation and thereto, 70 g of lime-processed gelatin was added and dissolved to adjust the pAg and the pH to 8.7 and 6.5, respectively. Thereafter, the emulsion was stored in a cool and dark place.

After re-dispersion, $1\times10^{-4}$ mol/mol-Ag of Compound (I-75) was added and aged at 40° C. for 10 minutes. The characteristics of the obtained tabular grains are shown in Table 4.

Emulsion 8-B (Invention)

Emulsion 8-B was prepared in the same manner as Emulsion 8-A except that Crystal Phase-Controlling Agent IV-1 was used in place of Crystal Phase-Controlling Agent I used as the crystal phase-controlling agent after the ripening of Emulsion 8-A. The characteristics of the obtained tabular grains are shown in Table 4.

Emulsion 8-C (Comparison)

Emulsion 8-C was prepared in the same manner as Emulsion 8-A except that Crystal Phase-Controlling Agent II was used in place of Crystal Phase-Controlling Agent I used as the crystal phase-controlling agent after the ripening of Emulsion 8-A. The characteristics of the obtained tabular grains are shown in Table 4.

Emulsion 8-D (Invention)

Emulsion 8-D was prepared in the same manner as Emulsion 8-A except that Crystal Phase-Controlling Agent V-1 was used in place of Crystal Phase-Controlling Agent I used as the crystal phase-controlling agent after the ripening of Emulsion 8-A. The characteristics of the obtained tabular grains are shown in Table 4.

Emulsion 8-E (Invention)

Emulsion 8-E was prepared in the same manner as Emulsion 8-A except that Crystal Phase-Controlling Agent V-2 was used in place of Crystal Phase-Controlling Agent I used as the crystal phase-controlling agent after the ripening of Emulsion 8-A. The characteristics of the obtained tabular grains are shown in Table 4.

TABLE 4

| | Average Thickness (μm) | Average Equivalent-Circle Diameter (μm) | Average Particle Ratio (projected area) |
|---|---|---|---|
| Emulsion 8-A (Comparison) | 0.048 | 4.6 | 92% |
| Emulsion 8-B (Invention) | 0.030 | 7.5 | 94% |
| Emulsion 8-C (Comparison) | 0.046 | 5.2 | 87% |
| Emulsion 8-D (Invention) | 0.031 | 7.2 | 90% |
| Emulsion 8-E (Invention) | 0.033 | 6.4 | 86% |

As seen from Table 4, in Emulsions 8-B, 8-D and 8-E using the crystal phase-controlling agent of the present invention, the average thickness of tabular grains is extremely small and the average equivalent-circle diameter is large, as compared with Emulsions 8-A and 8-C. Also, in any of Emulsions 8-B, 8-D and 8-E of the present invention, the tabular grain ratio is high. This reveals that the crystal phase-controlling agent of the present invention is advantageous in forming tabular grains having a high aspect ratio.

I-75

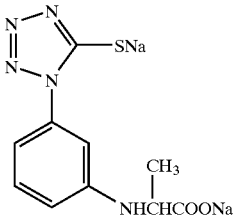

Example 9

Silver Iodobromide Tabular Grain Emulsion

Emulsion 9-A (Comparison)

In a system shown in FIG. 2 of JP-A-10-239787, tabular grains were prepared as follows using a mixing vessel (inner volume of mixing vessel: 0.5 mL) shown in FIG. 1 of JP-A-10-239787. In this Example, a method of performing both the nucleation and the grain growth using a mixing vessel is described.

In a mixing vessel, 250 mL of an aqueous 0.0029M silver nitrate solution and 250 mL of an aqueous 0.0089M KBr solution containing 0.1% by mass (i.e., by weight) of low molecular weight gelatin (average molecular weight: 40,000) were continuously added over 10 minutes and the obtained product was received into the reaction vessel to obtain 500 mL of a nucleus emulsion. At this time, the stirring and rotation number of the mixing vessel was 2,000 rpm. (Nucleation)

After the completion of nucleation, while thoroughly stirring the nucleus emulsion within the reactor, 11 mL of a 0.8M KBr solution and 200 mL of 10% by mass trimellited gelatin containing 0.1 mmol of Crystal Phase-Controlling Agent I were added and after elevating the temperature to 75° C., the emulsion was left standing for 30 minutes. (Ripening)

To the emulsion after ripening, 300 mL of a 10% by mass solution of lime-treated gelatin crosslinked by a vinylsulfone-base crosslinking agent [H-6] described in JP-A-11-237704, where the sum of void and γ moieties occupies 40% in the entire gelatin in the molecular weight distribution measured by the PAGI method, was added and dissolved. Then, 60 mL of a 0.04M $Al(NO_3)_3.9H_2O$ solution was added and after 2 minutes, 60 mL of 1/50M Crystal Phase-Controlling Agent I was added.

Thereafter, 1,000 mL of an aqueous 0.6M silver nitrate solution and 1,000 mL of an aqueous 0.59M KBr solution containing 90 g of a low molecular weight lime-processed gelatin (average molecular weight: 40,000) were again added to the mixing vessel each in a constant amount over 92 minutes. The fine grain emulsion produced in the mixing vessel was consecutively added to the reactor. At this time, the stirring and rotation number of the mixing vessel was 2,000 rpm. At the same time, 90 mL of a solution of 1/50M Crystal Phase-Controlling Agent I and 92 mL of a 1.45M KBr solution were continuously added to the reactor each at a constant flow rate over 92 minutes. The stirring blade in the reactor was rotated at 800 rpm and the emulsion was thoroughly stirred. (Growth) During the growth of grains, $8\times10^{-8}$ mol/mol-Ag of $IrCl_6$ was added and doped when 70% of silver nitrate was added. Before the completion of grain growth, a solution of yellow prussiate of potash was added to the mixing vessel. The yellow prussiate of potash was doped to give a local concentration of $3\times10^{-4}$ mol/mol-Ag in 3% (in terms of silver added) of the shell part. 5 Minutes after the completion of grain growth, Sensitizing Dye I corresponding to 70% of the saturated adsorption amount was added and the pBr was adjusted to 4.6. After the adjustment of pBr and keeping of 40 minutes at 75° C., the emulsion was cooled to 35° C. and washed by ordinary flocculation and thereto, 70 g of lime-processed gelatin was added and dissolved to adjust the pAg and the pH to 8.7 and 6.5, respectively.

After re-dispersion, $1\times10^{-4}$ mol/mol-Ag of Compound (I-75) was added and aged at 40° C. for 10 minutes. The characteristics of the obtained tabular grains are shown in Table 5.

Emulsion 9-B (Invention)

Emulsion 9-B was prepared in the same manner as Emulsion 9-A except that Crystal Phase-Controlling Agent IV-1 was used in place of Crystal Phase-Controlling Agent I used as the crystal phase-controlling agent after the ripening of Emulsion 9-A. The characteristics of the obtained tabular grains are shown in Table 5.

Emulsion 9-C (Comparison)

Emulsion 9-C was prepared in the same manner as Emulsion 9-A except that Crystal Phase-Controlling Agent II was used in place of Crystal Phase-Controlling Agent I used as the crystal phase-controlling agent after the ripening of Emulsion 9-A. The characteristics of the obtained tabular grains are shown in Table 5.

Emulsion 9-D (Invention)

Emulsion 9-D was prepared in the same manner as Emulsion 9-A except that Crystal Phase-Controlling Agent V-1 was used in place of Crystal Phase-Controlling Agent I used as the crystal phase-controlling agent after the ripening of Emulsion 9-A. The characteristics of the obtained tabular grains are shown in Table 5.

Emulsion 9-E (Invention)

Emulsion 9-E was prepared in the same manner as Emulsion 9-A except that Crystal Phase-Controlling Agent V-2 was used in place of Crystal Phase-Controlling Agent I used as the crystal phase-controlling agent in the ripening of Emulsion 9-A. The characteristics of the obtained tabular grains are shown in Table 5.

TABLE 5

| Emulsion | Average Equivalent-Circle Diameter (μm) | Average Thickness (μm) | Average Particle Ratio (projected area) | Remaining of Fine Particle (%) |
|---|---|---|---|---|
| 9-A (Comparison) | 0.046 | 4.7 | 91% | 15% |
| 9-B (Invention) | 0.031 | 7.2 | 94% | 7% |
| 9-C (Comparison) | 0.044 | 5.4 | 81% | 17% |
| 9-D (Invention) | 0.031 | 6.7 | 92% | 3% |
| 9-E (Invention) | 0.032 | 6.6 | 86% | 6% |

The residual amount of crystal phase-controlling agent adsorbing to tabular grains is shown by a ratio to the amount of the crystal phase-controlling agent added at the nucleation. Ammonium thiosulfate as a solvent was added to each sample, silver halide grains were dissolved therein and the amount of crystal phase-controlling agent was determined by high performance liquid chromatography.

As seen from Table 5, Emulsions 9-B, 9-D and 9-E using the crystal phase-controlling agent of the present invention are excellent in all of the average thickness of tabular grains, the size of the (111) main plane and the tabular grain ratio, as compared with Emulsions 9-A and 9-C, and are small in the residual amount of crystal phase-controlling agent on a tabular grain.

Dye 1

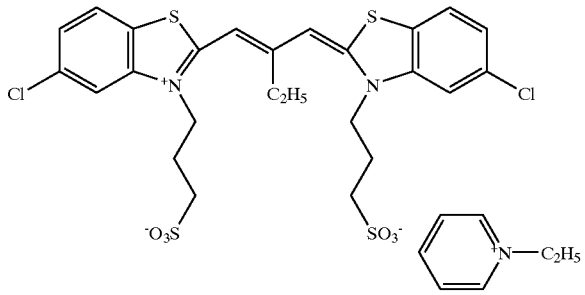

Example 10

The emulsions of Example 9 each was subjected to optimal chemical sensitization by adding sodium thiosulfate, chloroauric acid and potassium thiocyanate. After adding gelatin and sodium dodecylbenzenesulfonate to each of these chemically sensitized emulsions, each emulsion was co-extruded together with a protective layer containing gelatin, polymethacrylate particles and 2,4-dichloro-6-hydroxy-s-triazine sodium salt on a triacetyl cellulose film support having an undercoat layer each to have a silver coverage of 2 g/m$^2$, thereby obtaining Coated Samples 10-A to 10-E.

Coated Samples 10-A to 10-E each was exposed (1 second) for sensitometry through an optical wedge using a blue band pass filter BPN-42 produced by Fuji Photo Film Co., Ltd., then developed at 20° C. for 10 minutes with a developer prepared according to the following formulation, subjected to stopping, fixing, water washing and drying in a usual manner, and determined on the optical density. The fog was determined by the minimum optical density and the sensitivity was evaluated by the logarithm of reciprocal of the exposure amount necessary for obtaining an optical density of fog+0.2 and expressed by a relative value to the sensitivity as 100 of Coated Sample 10-A. The results obtained are shown in Table 6.

Developer

| | |
|---|---|
| Metol | 2.5 g |
| L-Ascorbic acid | 10.0 g |
| Nabox | 35.0 g |
| KBr | 1.0 g |

Water was added to make 1 L and the pH was adjusted to 9.6.

TABLE 6

| Coated Sample | Sensitivity |
|---|---|
| 10-A (Comparison) | 100 |
| 10-B (Invention) | 142 |
| 10-C (Comparison) | 103 |
| 10-D (Invention) | 134 |
| 10-E (Invention) | 122 |

As seen from Table 6, Coated Samples 10-B, 10-D and 10-E using the crystal phase-controlling agent of the present invention have extremely high sensitivity as compared with Coated Samples 10-A and 10-C. This is presumed to result because the surface area/volume ratio of a tabular grain in Emulsions 10-B, 10-D and 10-E is high as compared with that of comparative Samples and the residual amount of crystal phase-controlling agent is small.

TABLE 11

Emulsion 8-B of Example 8 was subjected to optimal chemical sensitization and used as the emulsion for the sixth layer of Sample 201 in Example 2 of JP-A-9-146237 and a coated sample was obtained by the same processing as in Example 2 of JP-A-9-146237. Also at this time, good results were obtained.

When the crystal phase-controlling agent of the present invention is used, a silver halide emulsion comprising tabular grains having a very small thickness with the main surfaces thereof having a very large surface area and being (111) face, can be obtained and this brings increase in the sensitivity. Furthermore, a method for producing silver halide grains using a crystal phase-controlling agent easily removable after the formation of tabular grains can be provided.

The entitle disclosure of each and every foreign patent application from which the benefit of foreign priority has been claimed in the present application is incorporated herein by reference, as if fully set forth herein.

The entitle disclosure of each and every foreign patent application from which the benefit of foreign priority has been claimed in the present application is incorporated herein by reference, as if fully set forth herein.

While the invention has been described in detail and with reference to specific embodiments thereof, it will be apparent to one skilled in the art that various changes and modifications can be made therein without departing from the spirit and scope thereof.

What is claimed is:

1. A method for producing a silver halide emulsion comprising light-sensitive silver halide grains having a silver bromide content of 70 mol % or more, with 60% or more of the entire projected area of said silver halide grains being occupied by tabular grains having an average grain thickness of less than 0.04 μm an average equivalent-circle diameter of 4 μm or more, and (111) face as main surfaces, comprising nucleation, ripening and growth steps and performing these steps while letting at least one compound represented by the following formula (I), (II) or (III) be absent at the time of nucleation and be present at the time of ripening and growth to obtain an emulsion comprising tabular grains, wherein a mixing vessel is separately provided from a reactor for performing the nucleation and/or growth of silver halide grains, an aqueous solution of a water-soluble silver salt and an aqueous solution of a water-soluble halide are fed to said mixing vessel and mixed to form silver halide fine grains, and said fine grains are immediately fed to the reactor to perform the nucleation and/or growth of silver halide grains in said reactor:

(I)

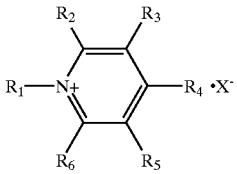

wherein $R_1$ represents an alkyl group, an alkenyl group or an aralkyl group, $R_2$, $R_3$, $R_4$, $R_5$ and $R_6$ each represents a hydrogen atom or a substituent, each of the pairs $R_2$ and $R_3$, $R_3$ and $R_4$, $R_4$ and $R_5$, and $R_5$ and $R_6$ may form a condensed ring, provided that at least one of $R_2$, $R_3$, $R_4$, $R_5$ and $R_6$ represents an aryl group, and $X^-$ represents a counter anion;

(II)

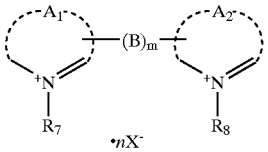

(III)

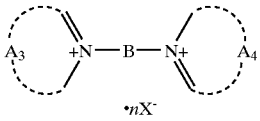

wherein $A_1$, $A_2$, $A_3$ and $A_4$, which may be the same or different, each represents a nonmetallic atom group for completing the nitrogen-containing heterocyclic ring, B represents a divalent linking group, m represents 0 or 1, $R^1$ and $R^2$ each represents an alkyl group, $X^-$ represents an anion, and n represents 0, 1 or 2, provided that when an inner salt is formed, n is 0 or 1.

2. The method for producing the silver halide emulsion as claimed in claim 1, comprising nucleation, ripening and growth steps and performing a part or the whole of the growth step in the presence of an alkali-treated ossein gelatin containing 30% or more of a γ component and a component having a molecular weight higher than that of the γ component, wherein a mixing vessel is separately provided from a reactor for performing the nucleation and/or growth of silver halide grains, an aqueous solution of a water-soluble silver salt and an aqueous solution of a water-soluble halide are fed to said mixing vessel and mixed to form silver halide fine grains, and said fine grains are immediately fed to the reactor to perform the nucleation and/or growth of silver halide grains in said reactor.

3. The method for producing a silver halide emulsion as claimed in claim 1, wherein an esterified gelatin is used as a protective colloid for the forming of said silver halide fine grains in said mixing vessel.

4. The method for producing a silver halide emulsion as claimed in claim 2, wherein an esterified gelatin is used as a protective colloid for the forming of said silver halide fine grains in said mixing vessel.

5. A method for producing a silver halide emulsion comprising light-sensitive silver halide grains having a silver bromide content of 70 mol % or more, with 60% or more of the entire projected area of said silver halide grains being occupied by tabular grains having an average grain thickness of less than 0.04 μm, an average equivalent-circle diameter of 4 μm or more, and (111) face as main surfaces, comprising nucleation, ripening and growth steps and performing these steps while letting at least one compound represented by the following formula (V) be absent at the time of nucleation and be present at the time of ripening and growth to obtain an emulsion comprising tabular grains, wherein a mixing vessel is separately provided from a reactor for performing the nucleation and/or growth of silver halide grains, an aqueous solution of a water-soluble silver salt and an aqueous solution of a water-soluble halide are fed to said mixing vessel and mixed to form silver halide fine grains, and said fine grains are immediately fed to the reactor to perform the nucleation and/or growth of silver halide grains in said reactor:

(V)

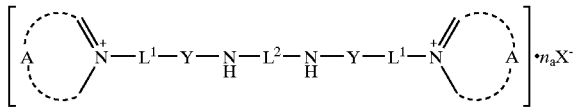

wherein A represents an organic residue for completing the nitrogen-containing aromatic heterocyclic ring and A's may be the same or different, $L^1$ and $L^2$ each represents a divalent linking group, Y represents —C(=O)—, —$SO_2$—, —NHC(=O)— or —NHC(=S)—, $X^-$ represents a counter anion, and $n_a$ represents a number necessary for neutralizing the electric charge of the compound.

6. A method for producing a silver halide emulsion comprising light-sensitive silver halide grains having a silver bromide content of 70 mol % or more, with 60% or more of the entire projected area of said silver halide grains being occupied by tabular grains having an average grain thickness of less than 0.04 μm, an average equivalent-circle diameter of 4 μm or more, and (111) face as main surfaces, comprising nucleation, ripening and growth steps and performing these steps while letting at least one compound represented by the following formula (V-A) be absent at the time of nucleation and be present at the time of ripening and growth to obtain an emulsion comprising tabular grains, wherein a mixing vessel is separately provided from a reactor for performing the nucleation and/or growth of silver halide grains, an aqueous solution of a water-soluble silver salt and an aqueous solution of a water-soluble halide are fed to said mixing vessel and mixed to form silver halide fine grains, and said fine grains are immediately fed to the reactor to perform the nucleation and/or growth of silver halide grains in said reactor:

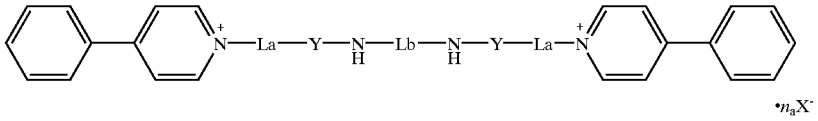

(V-A)

wherein La represents a divalent linking group constituted by any one or a combination of two or more of an alkylene group, an arylene group and an alkenylene group, Lb represents a divalent group constituted by any one or a combination of two or more of an alkylene group, an arylene group, an alkenylene group, —$SO_2$—, —SO—, —O—, —S—, —CO—, —NH— and —N($R_{16}$)—, $R_{16}$ represents an alkyl group, an alkenyl group, an aralkyl group or an aryl group, Y represents —C(═O)—, —$SO_2$—, —NHC(═O)— or —NHC(═S)—, $X^-$ represents a counter anion, $n_a$ represents a number necessary for neutralizing the electric charge of the compound.

* * * * *